US011560814B1

(12) United States Patent
Figueiredo et al.

(10) Patent No.: US 11,560,814 B1
(45) Date of Patent: Jan. 24, 2023

(54) RECIRCULATING HYDRAULIC FLUID CONTROL VALVE

(71) Applicant: Schaeffler Technologies AG & Co. KG, Herzogenaurach (DE)

(72) Inventors: Gustavo de Oliveira Figueiredo, Sterling Heights, MI (US); Andrew Mlinaric, Lakeshore (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/580,713

(22) Filed: Jan. 21, 2022

(51) Int. Cl.
*F01L 1/344* (2006.01)
*F01L 13/00* (2006.01)

(52) U.S. Cl.
CPC ..... *F01L 1/3442* (2013.01); *F01L 2001/3443* (2013.01); *F01L 2013/101* (2013.01); *F01L 2820/031* (2013.01)

(58) Field of Classification Search
CPC ..... F01L 1/3442; F01L 2001/34423; F01L 2001/34426; F01L 2001/3443; F01L 2013/101; F01L 2820/031
USPC ..... 123/90.17
See application file for complete search history.

(56) References Cited

U.S. PATENT DOCUMENTS

2015/0300213 A1 10/2015 Kaufmann et al.
2016/0010515 A1* 1/2016 Snyder ..... F01L 1/3442 123/90.15
2017/0058726 A1 3/2017 Smith et al.
2017/0058727 A1* 3/2017 Smith ..... F01L 1/047
2018/0016950 A1 1/2018 Haltiner, Jr.
2018/0363514 A1* 12/2018 Stanhope ..... F01L 1/3442
2019/0107014 A1 4/2019 Smith
2019/0234244 A1* 8/2019 Hisaeda ..... F01L 1/022
2020/0370450 A1* 11/2020 Huerta Ortiz ..... F01L 1/344
2021/0180476 A1* 6/2021 Hamada ..... F16K 3/28
2021/0215070 A1 7/2021 Figueiredo et al.
2021/0277808 A1* 9/2021 Kenyon ..... F01L 1/3442
2021/0381403 A1* 12/2021 Mitsutani ..... F01L 1/3442

FOREIGN PATENT DOCUMENTS

CN 110318836 A1 10/2019
CN 110359976 A 10/2019
CN 110360347 A 10/2019
DE 102016118962 A1 4/2018

* cited by examiner

*Primary Examiner* — Jorge L Leon, Jr.

(57) ABSTRACT

A hydraulic fluid control valve (HFCV) configured to recirculate an existing hydraulic fluid from a first hydraulic actuation chamber to a second hydraulic actuation chamber is provided. The HFCV includes a selectively movable spool assembly having an outer annulus, at least one one-way valve arranged within the outer annulus, and an inner fluid chamber configured to receive and deliver the exiting hydraulic fluid to one or both of either a sump or one of the first or second hydraulic actuation chambers. The at least one one-way valve moves in an axial direction and the outer annulus serves as an axial motion stop for the at least one one-way valve.

20 Claims, 13 Drawing Sheets

RECIRCULATING HYDRAULIC FLUID CONTROL VALVE

TECHNICAL FIELD

This disclosure is generally related to a hydraulic fluid control valve that can be applied to a hydraulically actuated component or system, including, but not limited to, a camshaft phaser or a cranktrain phaser for an internal combustion (IC) engine.

BACKGROUND

A hydraulic fluid control valve can manage delivery of pressurized hydraulic fluid to a hydraulically actuated component such as a camshaft phaser or a cranktrain phaser of an internal combustion engine. Pressurized hydraulic fluid in an internal combustion engine is provided by a hydraulic fluid pump that is fluidly connected to a reservoir or sump of hydraulic fluid. The size, and, thus, power requirement of the hydraulic fluid pump is dependent upon a total volume of pressurized fluid that is requested or consumed by the internal combustion engine and its associated hydraulic fluid systems. This requested or consumed hydraulic fluid can be reduced by recirculating and re-using at least some of the hydraulic fluid that is typically returned to the reservoir or sump after being utilized for actuation purposes within a hydraulically actuated component.

SUMMARY

An example embodiment of a hydraulic fluid control valve is provided that includes a housing and a spool assembly. The housing has a first fluid port configured to be fluidly connected to a first hydraulic actuation chamber and a second fluid port configured to be fluidly connected to a second hydraulic actuation chamber. The first and second hydraulic actuation chambers are configured to receive and exit hydraulic fluid. The spool assembly is configured to move axially within the housing to route hydraulic fluid to and from the first and second fluid ports. The spool assembly includes a first spool part and a second spool part configured as a separate component from the first spool part. The spool assembly has at least one one-way valve configured to recirculate at least a portion of vented hydraulic fluid from one of the first or second hydraulic actuation chamber to a remaining one of the first or second hydraulic actuation chamber. The spool assembly has an inner fluid chamber formed by the first and second spool parts. The inner fluid chamber has a vent aperture and at least one recirculation aperture. The inner fluid chamber is configured to: i) receive the vented hydraulic fluid, ii) provide a first fluid pathway for a first portion of the vented hydraulic fluid to the vent aperture, and iii) provide a second fluid pathway for a remaining portion of the vented hydraulic fluid to the at least one one-way valve via the at least one recirculation aperture. The spool assembly includes a connection tube configured to assemble the first spool part to the second spool part so that the first spool part is attached to the second spool part via the connection tube. The connection tube is configured as an axial motion stop for the at least one one-way valve.

The hydraulic fluid control valve is configured to manage hydraulic fluid flow for one of either a camshaft phaser or a phaser for a cranktrain of an internal combustion engine.

The first and second spool parts can form an outer annulus that is configured to be in selective fluid communication with the first and second fluid ports of the housing. The at least one one-way valve can be arranged in and slidably guided in an axial direction by the outer annulus. At least a portion of the connection tube can extend within the outer annulus.

In an example embodiment, the at least one one-way valve can include a first one-way valve and a second one-way valve. A bias spring can be arranged between the first and second one-way valves and configured to bias both the first and second one-way valves. The bias spring can bias the first and second one-way valves to a closed position.

In an example embodiment, the spool assembly can include a first bias spring configured to bias the first one-way valve to an open position, and a second bias spring configured to bias the second one-way valve to an open position. The first bias spring can be housed within an axially extending first spring cavity of the first one-way valve, and the second bias spring can be housed within an axially extending second spring cavity of the second one-way valve. A first end of the connection tube can be an axial motion stop for the first one-way valve and a second end of the connection tube can be a second axial motion stop for the second one-way valve.

In an example embodiment, the first one-way valve opens in a first axial direction and the second one-way valve opens in a second axial direction, opposite the first axial direction.

An example embodiment of a hydraulic fluid control valve is provided that includes a hydraulic sleeve disposed within the housing. The hydraulic sleeve includes longitudinal cutouts that are configured to receive hydraulic fluid from a hydraulic fluid pressure source. The hydraulic fluid control valve includes at least one one-way valve with: i) a radial inner surface slidably guided by an outer annulus of the spool assembly, and ii) a radial outer surface slidably guided by the hydraulic sleeve. The hydraulic fluid control valve includes a spool assembly having an inner fluid chamber with a vent aperture and at least one recirculation aperture. The inner fluid chamber is configured to receive vented hydraulic fluid from one of the first or second hydraulic actuation chambers and provide: i) a first fluid pathway for a first portion of the vented hydraulic fluid to the vent aperture, and ii) a second fluid pathway for a remaining portion of the vented hydraulic fluid to the at least one one-way valve via the at least one recirculation aperture.

In an example embodiment, the outer annulus of the spool assembly is configured as an axial motion stop for the at least one one-way valve.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
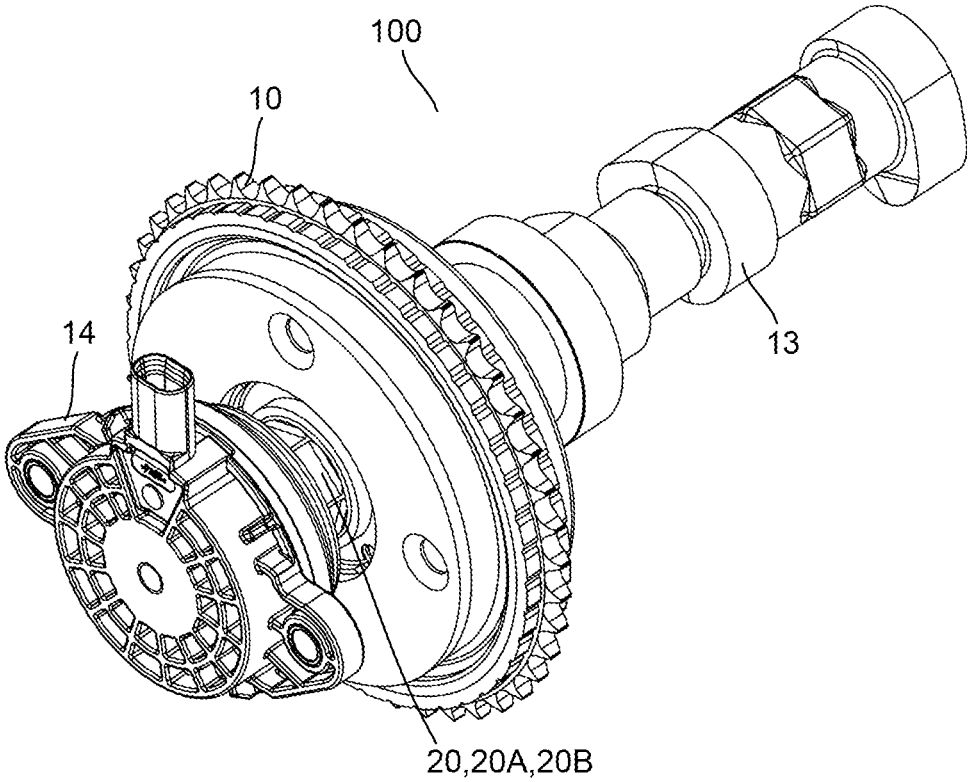
FIG. 1 is a perspective view of camshaft phaser system that includes an actuator, a hydraulic fluid control valve (HFCV), a camshaft phaser, and a camshaft.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis or a rotational axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
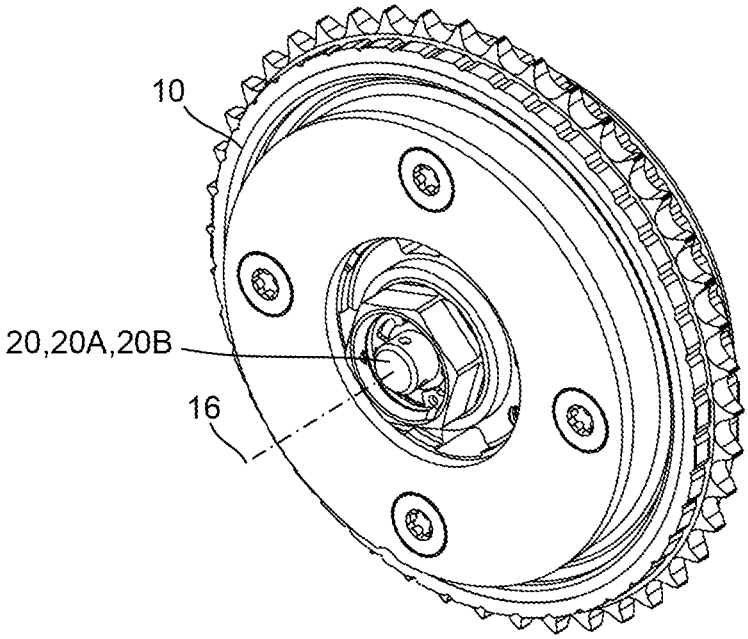
FIG. 2 is a perspective view of the camshaft phaser and HFCV of FIG. 1.
Figure 3:
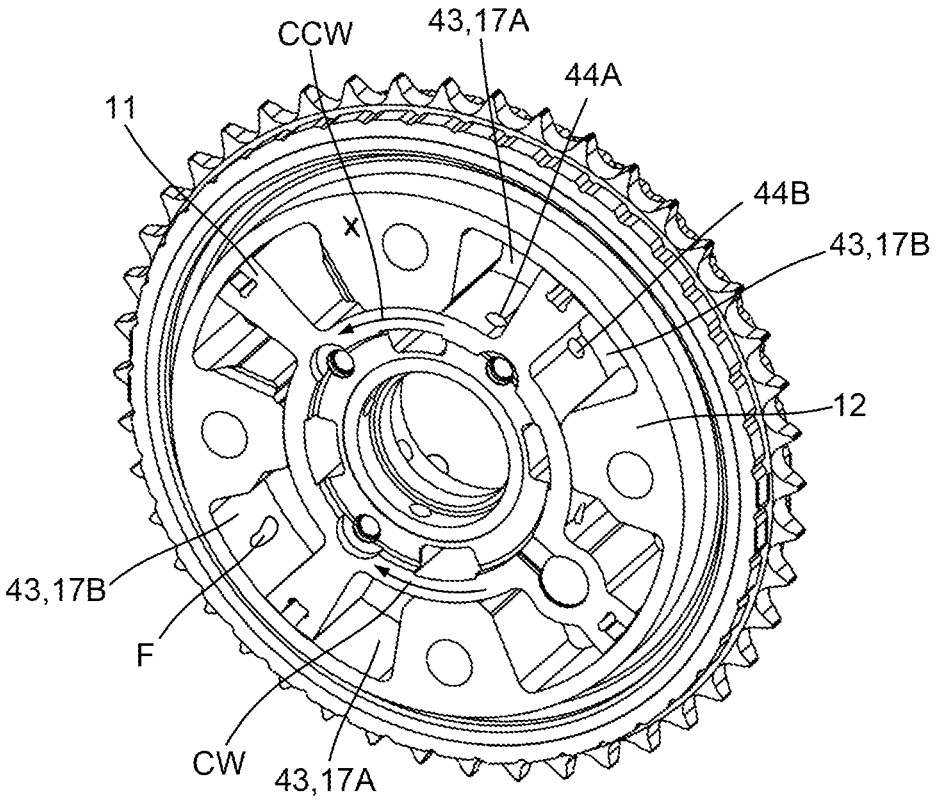
FIG. 3 is a perspective view of a rotor and a stator of the camshaft phaser of FIG. 1.
Figure 4:
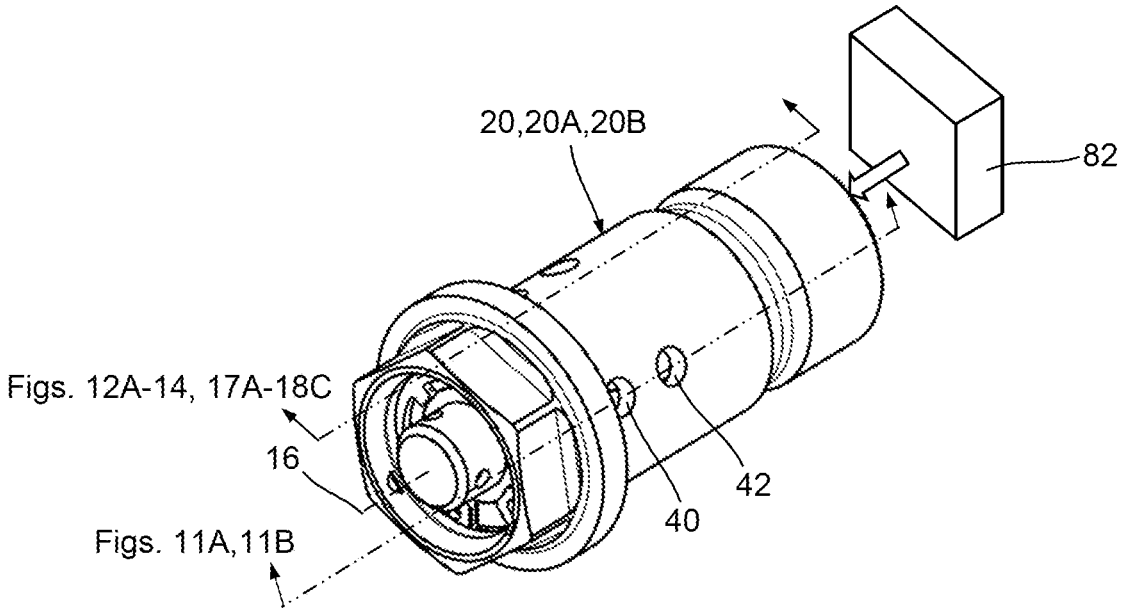
FIG. 4 is a perspective view of example embodiments of an HFCV together with a hydraulic fluid pressure source.
Figure 5:
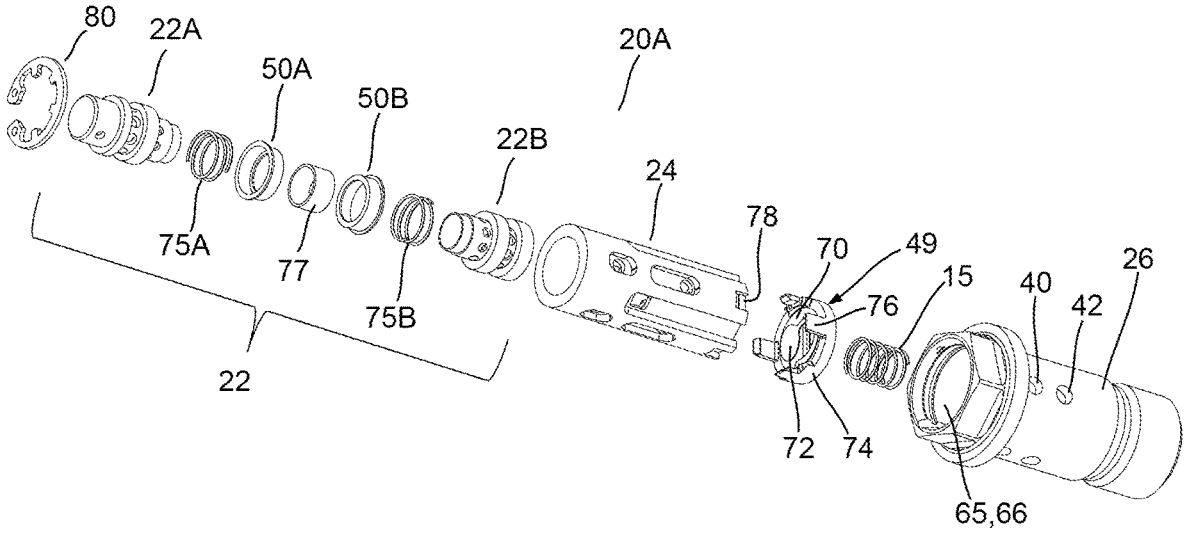
FIG. 5 is an exploded perspective view of a first example embodiment of the HFCV of FIG. 4 including a first spool part, a second spool part, a connection tube, two one-way valves, two one-way valve springs, a hydraulic sleeve, and an outer housing.
Figure 6A:
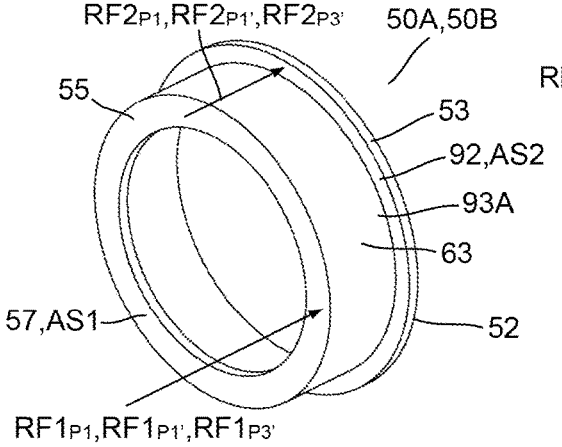
FIGS. 6A and 6B are perspective views of the two one-way valves of FIG. 5.
Figure 6B:
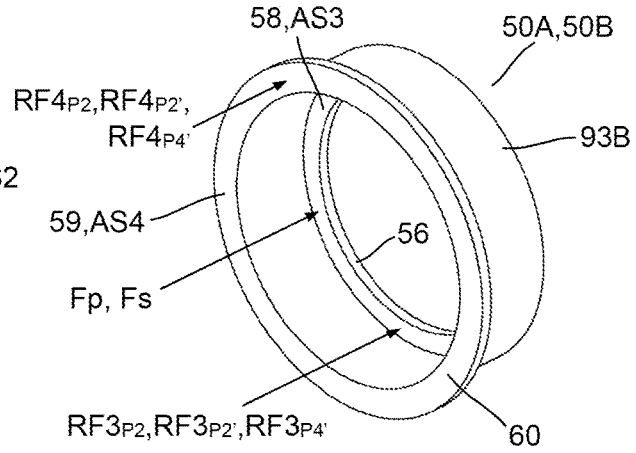
Figure 7:
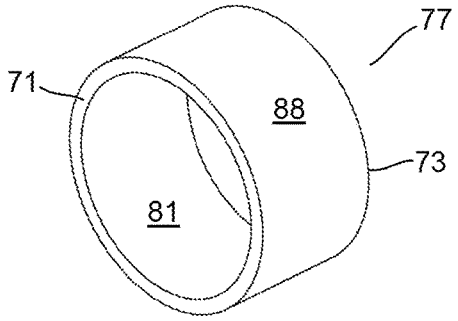
FIG. 7 is a perspective view of the connection tube of FIG. 5.
Figure 8A:
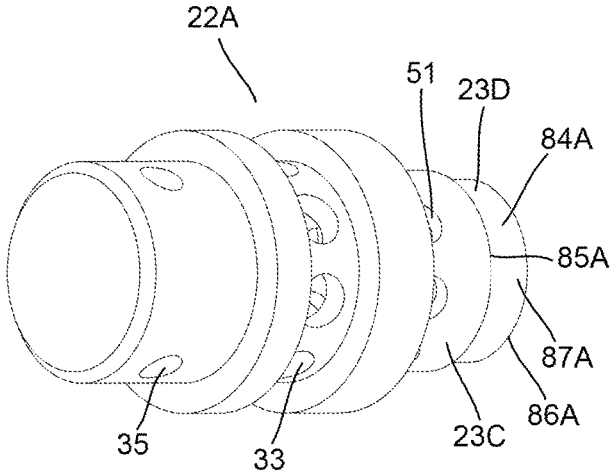
FIG. 8A is a perspective view of the first spool part of FIG. 5.
Figure 8B:
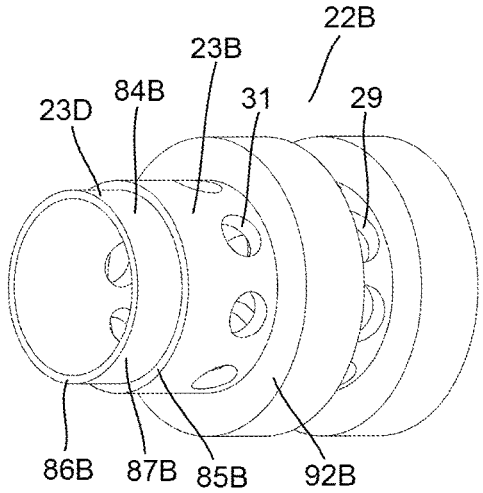
FIG. 8B is a perspective view of the second spool part of FIG. 5.
Figure 9:
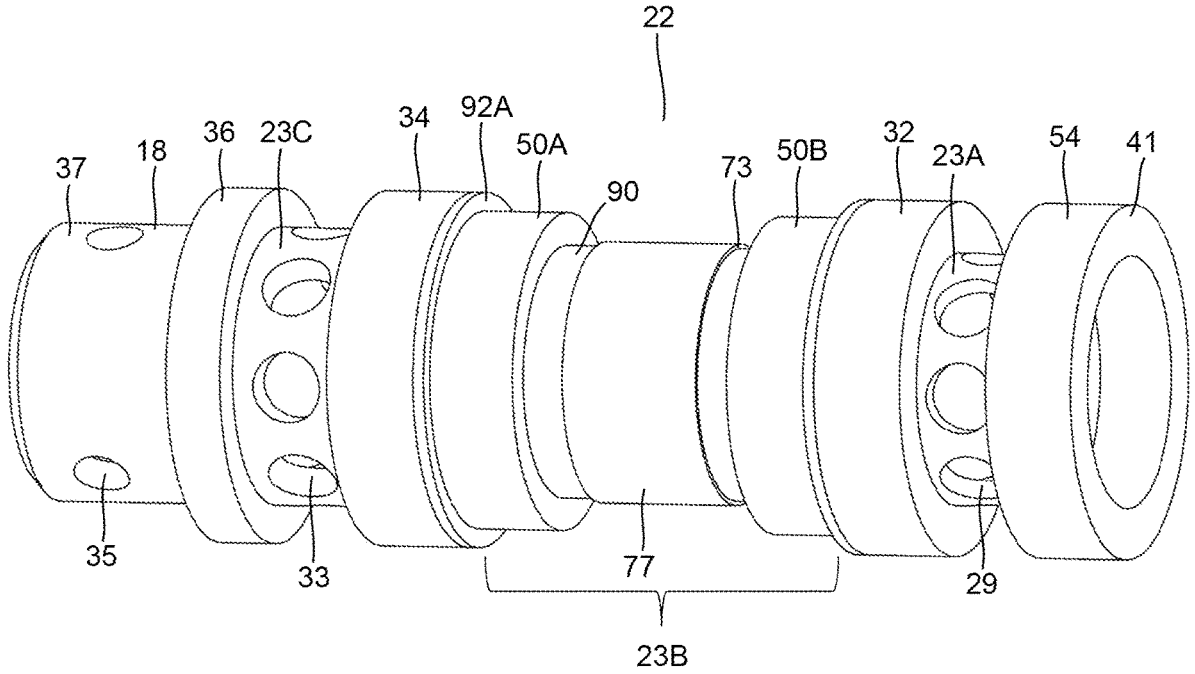
FIG. 9 is a perspective view of a spool assembly that includes the first and second spool parts, the first and second one-way valves, and the connection tube of FIG. 5
Figure 10A:
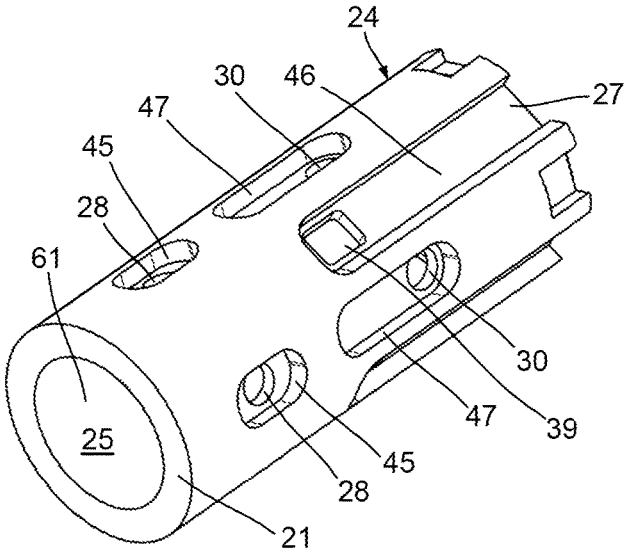
FIG. 10A is a perspective view of the hydraulic sleeve of FIG. 5.
Figure 10B:
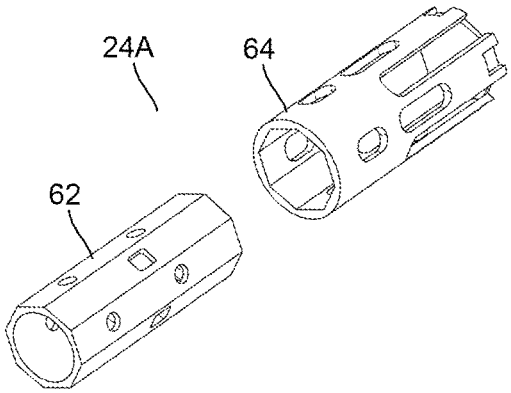
FIG. 10B is an exploded perspective view of an example embodiment of a hydraulic sleeve.
Figure 11A:
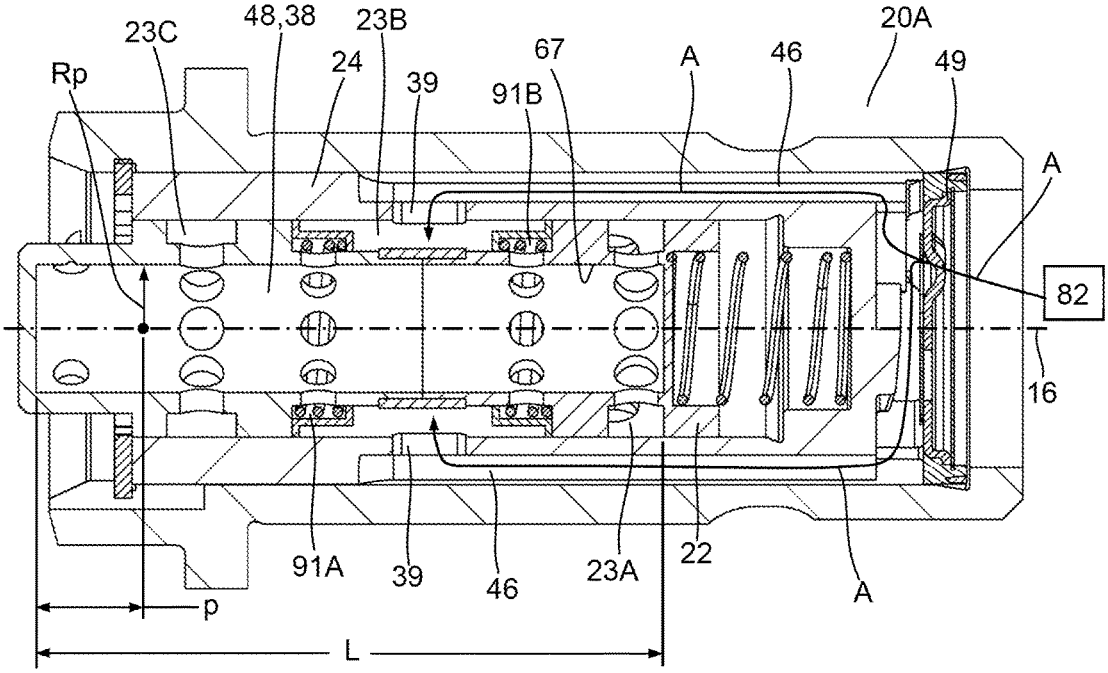
FIG. 11A is a cross-sectional view taken from the first example embodiment of the HFCV of FIG. 4 showing an inlet hydraulic fluid pathway when the spool is in an extended position.
Figure 11B:
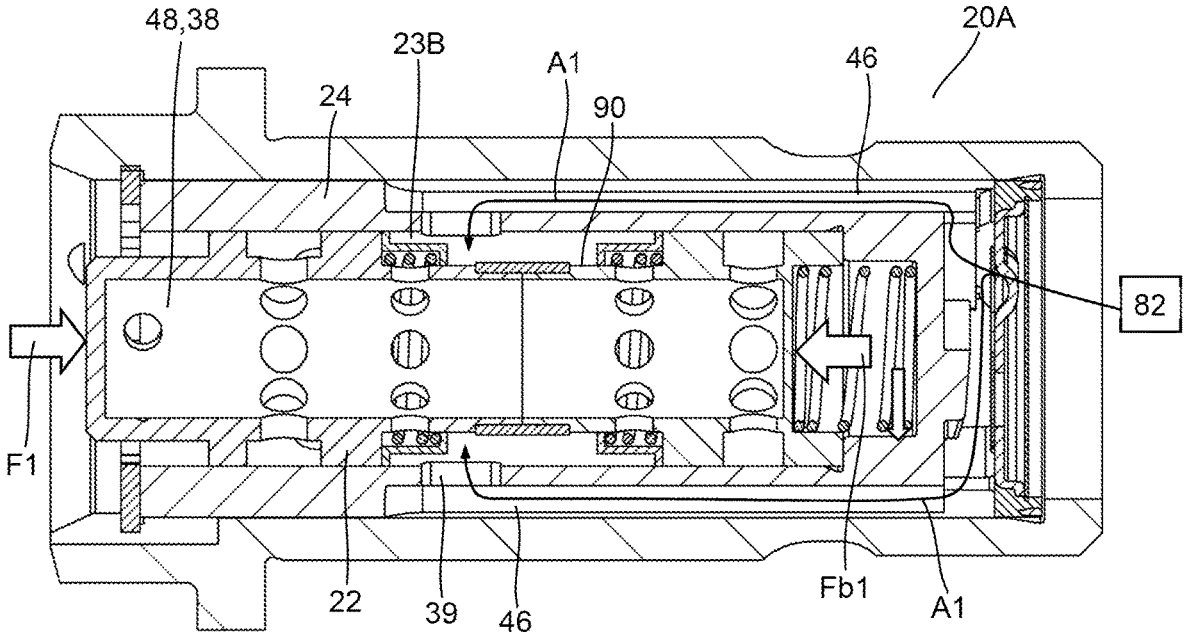
FIG. 11B is a cross-sectional view taken from the first example embodiment of the HFCV of FIG. 4 showing an inlet hydraulic fluid pathway when the spool is in a fully displaced position.
Figure 12A:
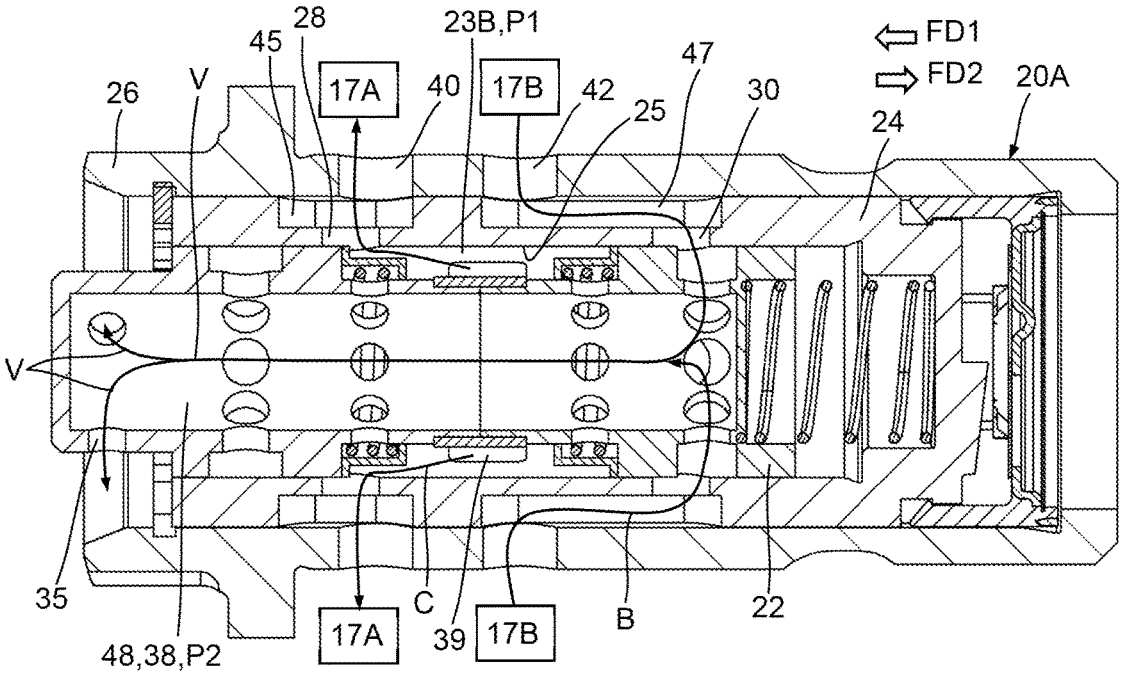
FIG. 12A is a cross-sectional view taken from the first example embodiment of the HFCV of FIG. 4 showing multiple hydraulic fluid paths when the spool is in an extended position, and the one-way valves are closed.
Figure 12B:
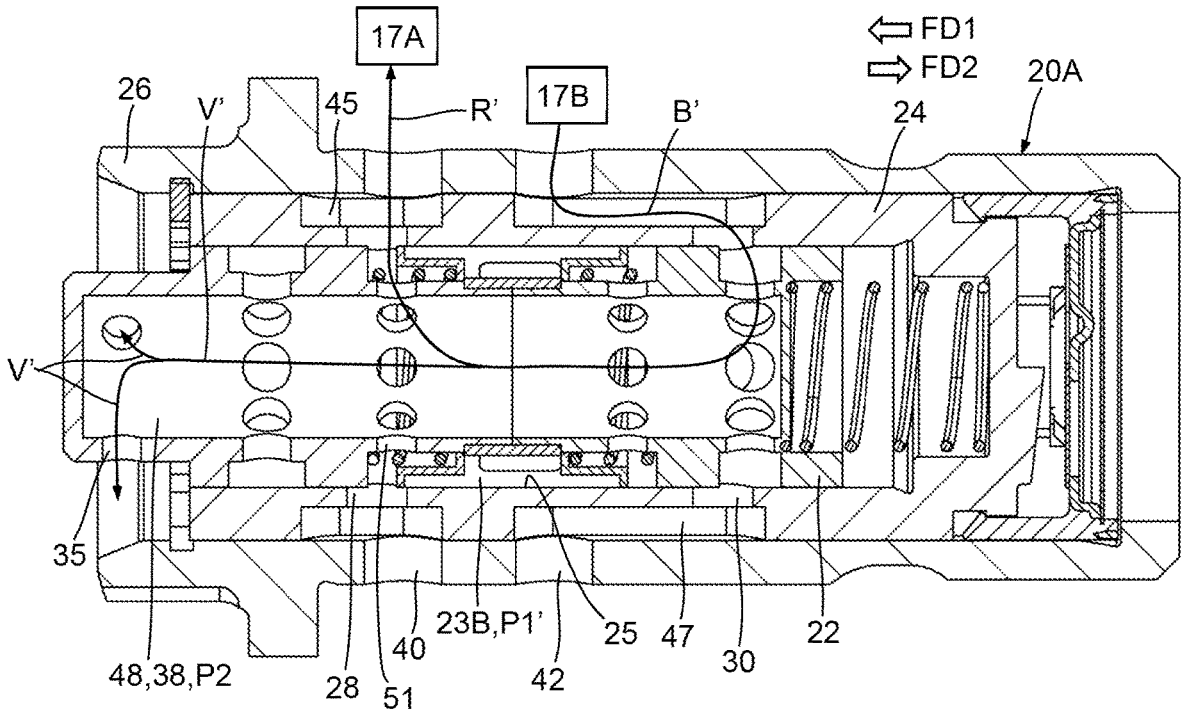
FIG. 12B is a cross-sectional view taken from the first example embodiment of the HFCV of FIG. 4 showing multiple hydraulic fluid paths when the spool is in an extended position, and the one-way valves are fully open.
Figure 13A:
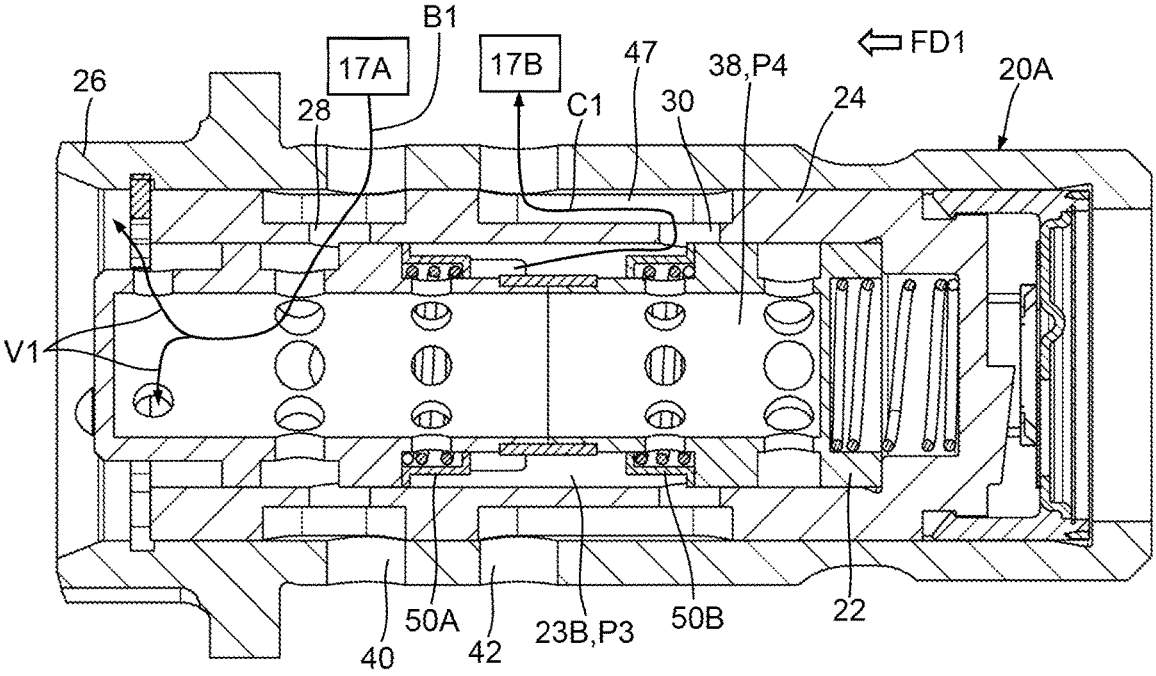
FIG. 13A is a cross-sectional view taken from the first example embodiment of the HFCV of FIG. 4 showing multiple hydraulic fluid paths when the spool is in a fully displaced position, and the one-way valves are closed.
Figure 13B:
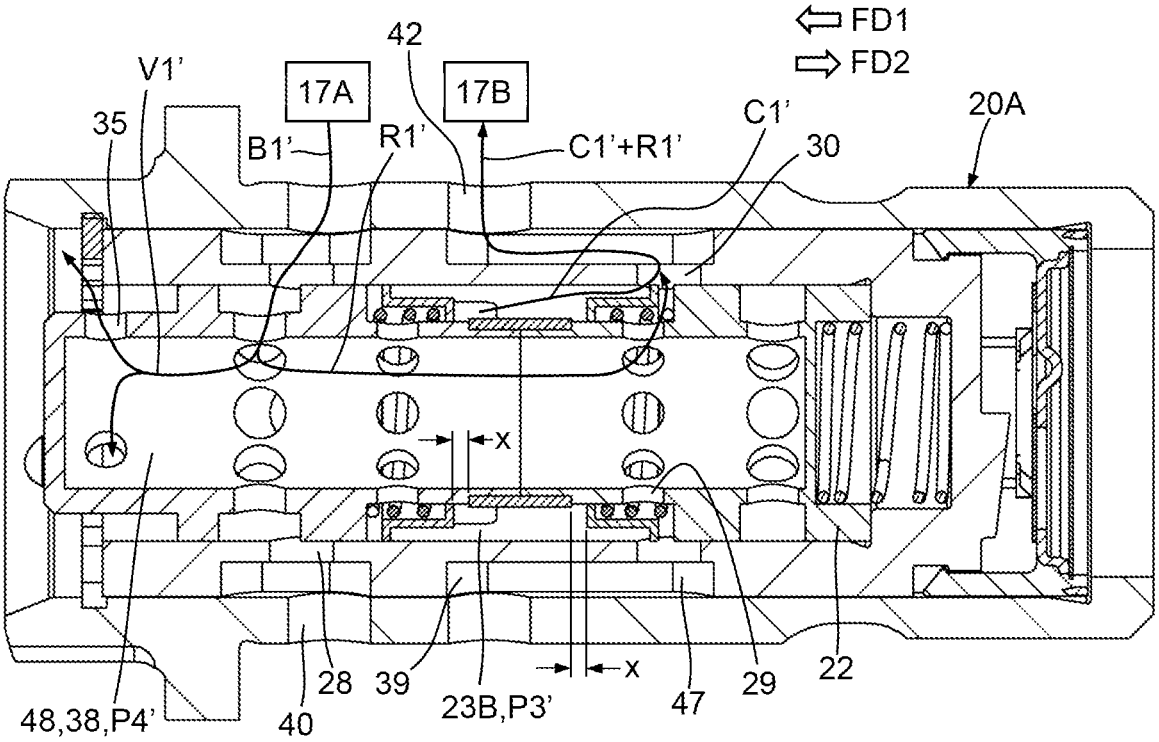
FIG. 13B is a cross-sectional view taken from the first example embodiment of the HFCV of FIG. 4 showing multiple hydraulic fluid paths when the spool is in a fully displaced position, and one-way valves are partially open.
Figure 13C:
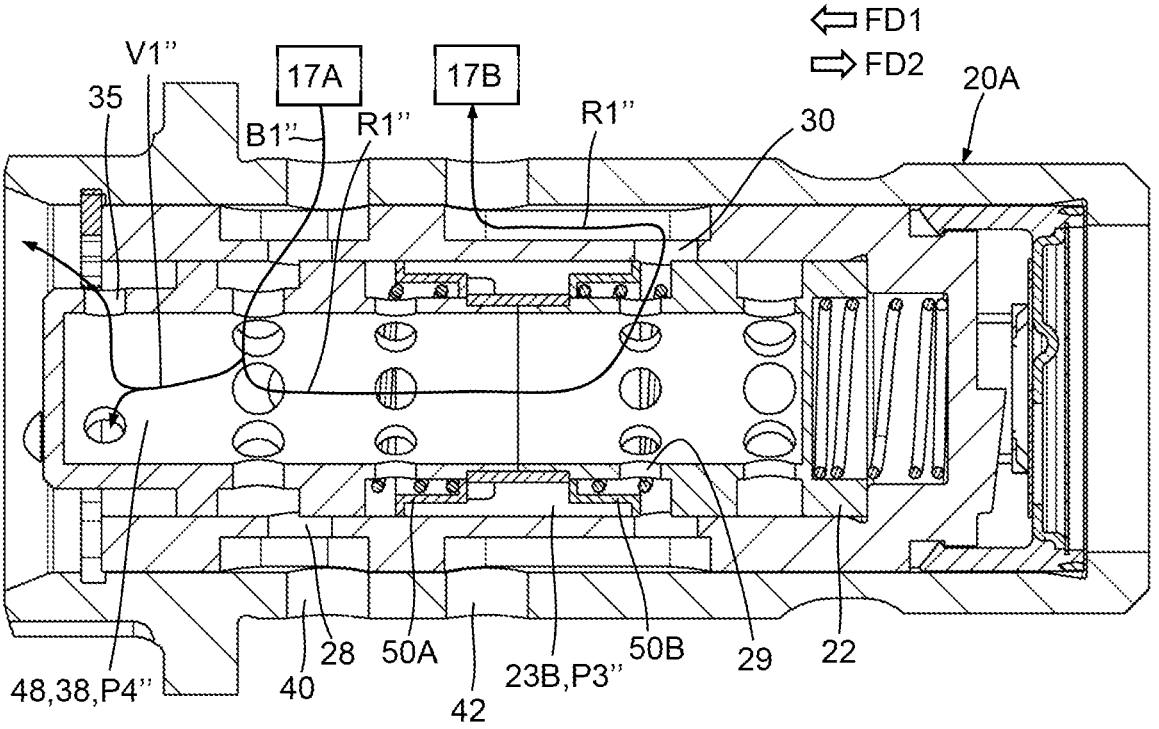
FIG. 13C is a cross-sectional view taken from the first example embodiment of the HFCV of FIG. 4 showing multiple hydraulic fluid paths when the spool is in a fully displaced position, and the one-way valves are fully open.
Figure 14:
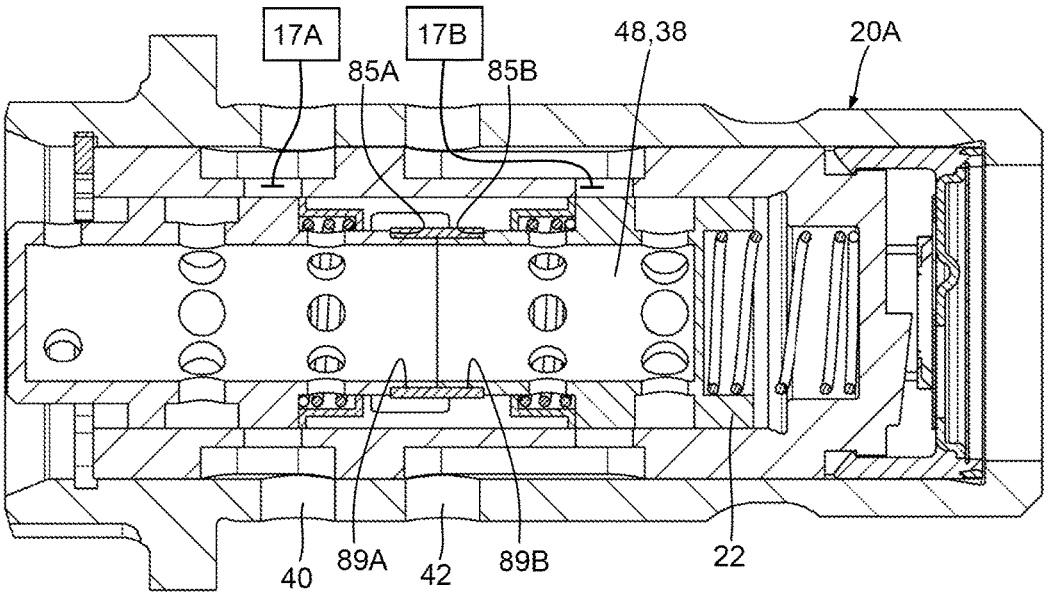
FIG. 14 is a cross-sectional view taken from the first example embodiment of the HFCV of FIG. 4 when the spool is in a middle position, and the one-way valves are closed.

FIG. 1 is a perspective view of a camshaft phaser system 100 that includes an actuator 14 that actuates a hydraulic fluid control valve (HFCV) 20 of a camshaft phaser 10 that is attached to a camshaft 13. The actuator 14 is electronically controlled by an electronic controller (not shown), such as an engine control unit (ECU). FIG. 2 is a perspective view of the camshaft phaser 10 and HFCV 20 of FIG. 1. FIG. 3 is a perspective view of a rotor 11 and a stator 12 of the camshaft phaser 10 that shows hydraulic actuation chambers 43 formed between the rotor 11 and stator 12. FIG. 4 is a perspective view of an example embodiment of an HFCV 20A together with a hydraulic fluid pressure source 82. FIG. 5 is an exploded perspective view of one of the HFCV example embodiments 20A, including a first spool part 22A, a second spool part 22B, a connection tube 77, a first one-way valve 50A, a second one-way valve 50B, a first bias spring 75A, a second bias spring 75B, a hydraulic sleeve 24, and a housing 26. FIGS. 6A and 6B are perspective views of the first and second one-way valves 50A, 50B of FIG. 5. FIG. 7 is a perspective view of the connection tube 77 of FIG. 5. FIG. 8A is a perspective view of the first spool part 22A of FIG. 5. FIG. 8B is a perspective view of the second spool part 22B of FIG. 5. FIG. 9 is a perspective view of a spool assembly 22. FIG. 10A is a perspective view of the hydraulic sleeve 24 of FIG. 5. FIG. 10B is an exploded perspective view of an example embodiment of a hydraulic sleeve 24A. FIG. 11A is a cross-sectional view taken from the HFCV 20A of FIG. 4 that shows an inlet hydraulic fluid pathway when the spool assembly 22 is in an extended position. FIG. 11B is a cross-sectional view taken from the HFCV 20A of FIG. 4 that shows an inlet hydraulic fluid pathway when spool assembly 22 is in a fully displaced position. FIG. 12A is a cross-sectional view taken from the HFCV 20A of FIG. 4 showing multiple hydraulic fluid paths when the spool assembly 22 is in an extended position, and the first and second one-way valves 50A, 50B are closed. FIG. 12B is a cross-sectional view taken from the HFCV 20A of FIG. 4 showing multiple hydraulic fluid paths when the spool assembly 22 is in an extended position, and the first and second one-way valves 50A, 50B are fully open. FIG. 13A is a cross-sectional view taken from the HFCV 20A of FIG. 4 showing multiple hydraulic fluid paths when the spool assembly 22 is in a fully displaced position, and the first and second one-way valves 50A, 50B are closed. FIG. 13B is a cross-sectional view taken from the HFCV 20A of FIG. 4 showing multiple hydraulic fluid paths when the spool assembly 22 is in a fully displaced position, and the first and second one-way valves 50A, 50B are partially open. FIG. 13C is a cross-sectional view taken from the HFCV 20A of FIG. 4 showing multiple hydraulic fluid paths when the spool assembly 22 is in a fully displaced position, and the first and second one-way valves 50A, 50B are fully open. FIG. 14 is a cross-sectional view taken from the HFCV 20A of FIG. 4 when the spool assembly 22 is in a middle position, and the first and second one-way valves 50A, 50B are closed. The following discussion should be read in light of FIGS. 1 through 14.

The camshaft phaser 10 is hydraulically actuated by pressurized hydraulic fluid F that is controlled by the HFCV 20 and actuator 14 to rotate the rotor 11 either clockwise CW or counterclockwise CCW about a rotational axis 16 relative to the stator 12 via hydraulic actuation chambers 43. As the rotor 11 is connected to the camshaft 13, clockwise CW and counterclockwise CCW rotation of the rotor 11 relative to the stator 12 can advance or retard an engine valve event with respect to a four-stroke cycle of an IC engine. Clockwise CW rotation of the rotor 11 relative to the stator 12 can be achieved by: 1). pressurization of first hydraulic actuation chambers 17A via a first hydraulic fluid gallery 44A arranged in the rotor 11; and, 2). de-pressurization of second hydraulic actuation chambers 17B via a second hydraulic fluid gallery 44B arranged in the rotor 11 that fluidly connects the second hydraulic actuation chambers 17B to tank via an exit through-aperture 35 arranged within the HFCV 20. Likewise, counterclockwise CCW rotation of the rotor 11 relative to the stator 12 can be achieved by: 1). pressurization of the second hydraulic actuation chambers 17B via the second hydraulic fluid gallery 44B arranged in the rotor 11; and, 2). de-pressurization of the first hydraulic actuation chambers 17A via the first hydraulic fluid gallery 44A that fluidly connects the first hydraulic actuation chambers 17A to tank via the exit through-aperture 35 arranged within the HFCV 20. The preceding pressurization and de-pressurization actions of the first and second hydraulic actuation chambers 17A, 17B can be accomplished by the HFCV 20. The HFCV 20 is fluidly connected to a hydraulic fluid pressure source 82 and is actuated by the actuator 14 which can communicate electronically with the ECU to control the camshaft phaser 10.

FIG. 5 shows an example embodiment of an HFCV 20A that includes a housing 26, an inlet filter assembly 49, a hydraulic sleeve 24, a bias spring 15, a spool assembly 22, and a retaining ring 80.

The spool assembly 22 of the HFCV 20A is biased outward or towards the actuator 14 by the bias spring 15. The actuator 14 can have a pulse-width modulated solenoid that moves an armature toward the HFCV 20A, applying a force F1 on an actuator end 37 of the spool assembly 22 to overcome a biasing force Fb1 of the bias spring 15 to selectively move the spool assembly 22 to a desired longitudinal position such as that shown in FIGS. 11B and 14. Other forms of actuators to move the spool assembly 22 are also possible. A position of the spool assembly 22 within the HFCV 20A is controlled by the ECU which can control a duty cycle of the solenoid arranged within the actuator 14. The HFCV 20A could also be arranged outside of the camshaft phaser 10 at a remote location within the IC engine. The HFCV 20A could also have a solenoid integrated within the HFCV that functions to move the spool assembly 22 instead of relying on a separate component, such as the actuator 14. The embodiments and functional strategies described herein can also apply to other HFCV arrangements not mentioned in this disclosure.

The HFCV 20A includes threads (not shown) arranged on the housing 26 that are received by threads (not shown) of the camshaft 13. The HFCV 20A can axially clamp the rotor 11 to the camshaft 13, such that the rotor 11 and camshaft 13 are drivably connected so that they rotate in unison.

Referring to FIGS. 12A and 12C, with view to FIG. 3, different longitudinal positions of the spool assembly 22 are shown in which pressurized hydraulic fluid is delivered selectively to either first or second hydraulic actuation chambers 17A, 17B via: i) first and second fluid galleries 44A, 44B that are arranged within the rotor 11; and, ii) first and second fluid ports 40, 42 arranged on the housing 26 of the HFCV 20.

Clockwise CW actuation of the rotor 11 relative the stator 12 requires pressurization of the first hydraulic actuation chambers 17A via the first hydraulic fluid gallery 44A and de-pressurization of the second hydraulic actuation chambers 17B via the second hydraulic fluid gallery 44B. Camshaft torques, sometimes referred to as "torsionals", act on the camshaft in both clockwise and counterclockwise directions and are a result of valve train reaction forces that act on an opening flank and a closing flank of a camshaft lobe as it rotates. Assuming a clockwise rotating camshaft 13, an opening flank of a camshaft lobe can cause a counterclockwise CCW torque on the camshaft and camshaft phaser due to valve train reaction forces; furthermore, a closing flank of a camshaft lobe can cause a clockwise torque due to valve train reaction forces. In the case of a counterclockwise CCW torque, it is possible that this torque can overcome a force of a pressurized fluid F acting on a vane (or vanes) of the rotor 11 that is actuating the rotor 11 in a clockwise CW direction relative to the stator 12. In such an instance, hydraulic fluid F can be forced out of the first hydraulic actuation chambers 17A. The lobe of the camshaft 13 continues to rotate until it achieves its apex (peak lift) and then engagement of the closing flank of the lobe with the valve train causes a clockwise torque CW to act on the camshaft lobe. A counterclockwise torque CCW followed by a clockwise torque CW can induce a negative pressure in the first hydraulic actuation chambers 17A, requesting more oil to fill the first hydraulic actuation chambers 17A. This disclosure describes a recirculating HFCV in the following paragraphs, that can not only increase an HFCV's reactiveness to such torsionals and resultant negative pressures but can also reduce a camshaft phaser's pressurized hydraulic fluid consumption. This operating principle is achieved by routing some of the hydraulic fluid that is exiting one group of hydraulic actuation chambers to the other group of hydraulic actuation chambers for replenishment purposes.

The spool assembly 22 includes a first spool part 22A, a second spool part 22B, a connection tube 77, a first one-way valve 50A, a first bias spring 75A, a second one-way valve 50B, and a second bias spring 75B. In an example embodiment, the first spool part 22A is separate and distinct from the second spool part 22B. In other words, the first and second spool parts 22A, 22B are manufactured as separate components. The first spool part 22A is assembled with the second spool part 22B via the connection tube 77. Various connection methods are possible to join, assemble, or attach the first spool part 22A to the second spool part 22B including, but not limited to, welding, gluing, or press-fitting. Such connection methods may or may not utilize a third component, such as the connection tube 77, to facilitate the assembly of the first spool part 22A to the second spool part 22B. Furthermore, the third component can be of any suitable design that fulfills the purpose of attaching or securing the first spool part 22A to the second spool part 22B. For the sake of describing the joining of the first spool part 22A to the second spool part 22B of this disclosure, root words such as "attach", "assemble", and "secure" are used to describe this joining. The context of these terms is meant to imply that the first spool part 22A is rigidly mounted to the second spool part 22A so that these parts move in unison; when one of the spool parts is axially displaced a distance Z, the other spool part is also axially displaced the same axial distance Z. In the example embodiment shown in the Figures, no relative movement between the first and second spool parts 22A, 22B occurs. Furthermore, in an example embodiment, the first and second spool parts 22A, 22B are sealingly joined to prevent leakage of hydraulic fluid at the joining interface.

In an example embodiment, the first and second one-way valves 50A, 50B of the spool assembly 22 are identical to each other; and the first and second bias springs 75A, 75B are identical to each other. Before the first spool part 22A is attached to the second spool part 22B via the connection tube 77, the first one-way valve 50A and the respective first bias spring 75A can be assembled on the first spool part 22A, and the second one-way valve 50B and the respective second bias spring 75B can be assembled on the second spool part 22B. After the first and second spool parts 22A, 22B are sealably attached to each other via the connection tube 77, the respective first and second one-way valves 50A, 50B and first and second bias springs 75A, 75B are arranged in an opposed configuration.

The attachment features and interfaces of the first and second spool parts 22A, 22B and connection tube 77 will now be described. A first joining end 87A of the first spool part 22A is attached to a second joining end 87B of the second spool part 22B via the connection tube 77. The first joining end 87A has a first spool abutment surface 86A, a first outer radial joining surface 84A, and a first axial joining surface 85A. The second joining end 87B has a second spool abutment surface 86B, a second outer radial joining surface 84B and a second axial joining surface 85B. The connection tube 77 has an inner radial joining surface 81, a first stop abutment surface 71, and a second stop abutment surface 73. In an example embodiment, the inner radial joining surface 81 of the connection tube 77 sealingly engages both the first and second outer radial joining surfaces 84A, 84B to form respective first and second press-fit joints 89A, 89B (see FIG. 14) at these respective interfaces. The first and second press-fit joints form a seal to prevent any leakage or flow of pressurized hydraulic fluid through these respective joints. The first and second spool parts 22A, 22B are joined together such that: A) the first spool abutment surface 86A of the first spool part 22A abuts with the second spool abutment surface 86B of the second spool part 22B; B) the first stop abutment surface 71 of the connection tube 77 abuts with the first axial joining surface 85A of the first spool part; and C) the second stop abutment surface 73 of the connection tube 77 abuts with the second axial joining surface 85B of the second spool part 22B. Other suitable joining arrangements between the connection tube 77 and first and second spool parts 22A, 22B are also possible.

The first and second one-way valves 50A, 50B are biased to an open position by the respective first and second bias springs 75A, 75B, such that: A) the axial stop surface 57 of the first one-way valve 50A engages the first stop abutment surface 71 of the connection tube 77, and B) the axial stop surface 57 of the second one-way valve 50B engages the second stop abutment surface 73 of the connection tube 77. Therefore, the connection tube 77 serves as an axial motion stop for the first and second one-way valves 50A, 50B.

Once assembled, the spool assembly 22 includes, in successive order: a spring end 41, a first land 54, a second land 32, a third land 34, a fourth land 36, and an actuator end 37. The first and second lands 54, 32 form a first segment of the spool assembly 22 that defines a first outer annulus 23A; the second and third lands 32, 34 form a second segment that defines a second outer annulus 23B; the third and fourth lands 34, 36 form a third segment that defines a third outer annulus 23C; and the fourth land 36 and the actuator end 37 form a fourth segment that defines a head portion 18. The spool assembly 22 further includes: at least one first through-aperture 29 arranged between the first and second lands 54, 32, within the first outer annulus 23A; at least one second through-aperture 31 and at least one third through-aperture 51 arranged between the second and third lands 32, 34, within the second outer annulus 23B; at least one fourth through-aperture 33 arranged between the third and fourth lands 34, 36, within the third outer annulus 23C; and, at least one exit or vent through-aperture 35 arranged between the fourth land 36 and an actuation end 37 of the spool assembly 22 within the head portion 18. The spool assembly 22 is closed at the actuation end 37 and open at the spring end 41. The spring end 41 abuts with and houses (surrounds) at least a portion of the bias spring 15.

The spool assembly 22 has a longitudinal bore 48 having an inner radial surface 67 and forms an inner fluid chamber 38. It could be stated that the inner fluid chamber 38 includes the first, second, third, fourth and exit through-apertures 29, 31, 51, 33, 35 such that the first, second, third, fourth, and exit through-apertures 29, 31, 51, 33, 35 are fluidly connected to the inner fluid chamber 38. Furthermore, the first, second, third, fourth, and exit through-apertures 29, 31, 51, 33, 35 can all be continuously fluidly connected to each other via the inner fluid chamber 38. That is, regardless of: a) the position of the spool, and b) whether the first and second one-way valves 50A, 50B are open or closed, a continuous fluid connection between any one of the five through-apertures 29, 31, 51, 33, 35 and any or all of the remaining four through-apertures can exist, as shown in the figures. For the discussion of this disclosure, two adjacent fluid galleries that are connected to each other via the first and second one-way valves 50A, 50B are "fluidly connected" but not "continuously fluidly connected", as there are defined fluid pressure conditions that do not yield a flow of fluid from one fluid gallery to the other.

The inner fluid chamber 38 is defined by a cavity, hollow or void that directly contacts and houses a volume of hydraulic fluid, particularly hydraulic fluid that is routed to or from the hydraulic actuation chambers 43. The inner fluid chamber 38 can be continuous without interruption (or continuously open), such that its entire length L directly contacts hydraulic fluid; stated otherwise, the inner fluid chamber 38 can be continuous from the first through-aperture 29 to the vent or exit through-aperture 35 so that hydraulic fluid can continuously flow and be housed within the inner fluid chamber 38 from the first through-aperture 29 to the exit through-aperture 35 without interruption. The inner fluid chamber 38 can be shaped as a bore, as shown in the figures, or any other suitable shape to receive and contact hydraulic fluid. As shown in the figures, additional components of the HFCV 20A are not installed or disposed within the inner fluid chamber 38, however, such an arrangement could be possible. As shown in FIG. 11A, a cross-sectional area of the inner fluid chamber 38 at any longitudinal position p within the length L of the inner fluid chamber 38 can be computed by multiplying a square of a radius Rp by pi (3.14159). The radius Rp extends from the rotational axis 16 of the HFCV 20A to the inner radial surface 67 of the bore 48 that defines the inner fluid chamber 38. The radius of the bore 48 shown in the figures is constant, however, the bore could have different radii throughout its length. Even so, the cross-sectional area of the inner fluid chamber 38 could still be defined by $((pi)\times Rp^2)$. In addition to being continuously open in a longitudinal direction from the first through-aperture 29 to the exit through-aperture 35, it could also be stated that the inner fluid chamber 38 is continuously open in a radial direction from the rotational axis 16 to the inner radial surface 67. A cutting plane that is arranged transversely to the rotational axis 16 and cuts through the inner fluid chamber 38 does not cut through any material (steel, plastic, etc.) from the radial surface 25 to the rotational axis 16. Therefore, the volume of the inner fluid chamber 38 can be determined by multiplying the cross-sectional area by the length L.

As shown in FIGS. 6A and 6B, the first and second one-way valves 50A, 50B (sometimes referred to as "check-valves") include an inner rim 55 and an outer rim 60 that are separated by a cylindrical body 63. It could be stated that a first 93A end of the cylindrical body 63 is adjoined with the outer rim 60 and a second end 93B of the cylindrical body 63 is adjoined with the inner rim 55. The inner rim 55 has a radial inner surface 56 that is slidably and sealingly guided by a radial surface 90 of the second outer annulus 23B. A radial outer surface 53 of the outer rim 52 is slidably and sealingly guided by a radial surface 25 of the bore 61 of the hydraulic sleeve 24. The first and second one-way valves 50, 50B form respective first and second spring cavities 91A, 91B with the second outer annulus 23B (see FIG. 11A). The first and second spring cavities 91A, 91B radially and axially surround, respectively, the first and second bias springs 75A, 75B such that the first and second spring cavities isolate the first and second bias springs 75A, 75B from a portion of the second outer annulus 23B that receives pressurized hydraulic fluid from the hydraulic fluid pressure source 82. It could be stated that the first and second one-way valves 50A, 50B radially surround the first and second bias springs 75A, 75B such that they serve as housings for the respective first and second bias springs 75A, 75B. The first and second spring cavities 91A, 91B are continuously fluidly connected to the respective third and second through-apertures 51, 31, and, thus, also to the inner fluid chamber 38. The first and second one-way valves 50A, 50B: i) permit or provide hydraulic fluid flow from the inner fluid chamber 38 to the first hydraulic actuation chamber 17A or the second hydraulic actuation chamber 17B via the third and second through-apertures 51, 31; and ii) prevent hydraulic fluid flow from the first hydraulic actuation chamber 17A and the second hydraulic actuation chamber 17B to the inner fluid chamber 38. The first and second one-way valves 50A, 50B can be of any suitable design for the described function and do not have to be that which is described herein and shown in the figures.

The spool assembly 22 is disposed at least partially in the bore 61 or hollow of the hydraulic sleeve 24. The hydraulic sleeve 24 is disposed in the bore 65 of the housing 26 and remains stationary relative to the housing 26. The first, second, third, and fourth lands 54, 32, 34, 36 of the spool assembly 22 engage and are slidably guided in a sealing manner by the radial surface 25 of the bore 61 of the hydraulic sleeve 24. In an embodiment without the hydraulic sleeve 24, the first, second, third, and fourth lands 54, 32, 34, 36 can slidably engage an inner surface 66 of a bore 65 of the housing 26. The hydraulic sleeve 24 has an open actuation end 21 and a closed fluid inlet end 27. The fluid inlet end 27 provides an abutment or housing for the bias spring 15 and an axial stop for the spring end 41 of the spool assembly 22. The hydraulic sleeve 24 includes inlet ports 39 arranged at an end of longitudinal cut-outs 46 of the hydraulic sleeve 24 that fluidly connect the spool assembly 22 to the hydraulic fluid pressure source 82. First and second hydraulic actuation chamber ports 28, 30, via corresponding first and second cut-outs 45, 47, fluidly connect the respective first hydraulic actuation chamber 17A and the second hydraulic actuation chamber 17B to the HFCV 20A.

FIG. 10B shows an example embodiment of a hydraulic sleeve 24A that includes a base tube 62 and an injection-molded casing 64 that is formed around the base tube 62. The injection-molded casing 64 can simplify the manufacturing process required to achieve the previously described fluid cut-outs and other features, as needed. Other suitable shapes of the base tube 62 and injection-molded casing 64 are possible.

The following discussion describes various hydraulic fluid pathways and the respective fluid connections that are present within the HFCV 20A with the spool assembly 22 in the three longitudinal positions shown in the cross-sectional views of FIGS. 11A through 14. Multiple incidences of the same hydraulic fluid pathways are present within the HFCV 20A, two of which are shown in an opposed arrangement within each of these cross-sectional views; stated otherwise, the two shown hydraulic fluid pathways are arranged symmetrically about the rotational axis 16, such that the cutting planes shown in FIG. 4 cut through the two opposed hydraulic fluid pathways. Therefore, the hydraulic fluid pathways shown via sketched curves at the top of each respective figure also have duplicative pathways at the bottom of each respective figure. Such duplicative pathways are shown in FIG. 12, for example, but are not shown in the remaining cross-sectional views. Furthermore, the respective features of the housing 26, hydraulic sleeve 24, and spool assembly 22 that enable the opposed hydraulic fluid pathway arrangements are likewise also arranged symmetrically about the rotational axis 16 of the HFCV 20A.

FIG. 11A shows a cross-sectional view of the HFCV 20A that cuts through the longitudinal cut-outs 46 of the hydraulic sleeve to clearly show a hydraulic fluid pathway A of the HFCV 20A when the spool assembly 22 is in a first extended position. In this first extended position of the spool assembly 22, hydraulic fluid moves through the inlet filter assembly 49 before it enters the hydraulic sleeve 24. Referring to FIG. 5, the inlet filter assembly 49 includes a housing 74, an inlet filter 70, and a one-way valve 72. The inlet filter assembly 49 is engaged with the hydraulic sleeve 24 via tabs 76 of the housing 74 that are received by tab landings 78 arranged on the hydraulic sleeve 24. The one-way valve 72 provides hydraulic fluid flow from the hydraulic fluid pressure source 82 to the HFCV 20, but not vice-versa. The hydraulic fluid moves through the open one-way valve 72, through the longitudinal cut-outs 46 and inlet ports 39 of the hydraulic sleeve 24, and into the second outer annulus 23B of the spool assembly 22. From the second outer annulus 23B, the hydraulic fluid continues to flow until it reaches the first hydraulic actuation chamber 17A as will now be explained.

FIG. 12A shows a cross-sectional view of the HFCV 20A that cuts through the fluid ports 40, 42 of the housing 26 while the spool assembly 22 is in the first extended position to clearly show additional hydraulic fluid pathways B, C, V. The first extended position of the spool assembly 22 depicted in FIG. 12A facilitates: i) delivery of pressurized hydraulic fluid to the first hydraulic actuation chambers 17A via the inlet ports 39 of the hydraulic sleeve 24, the second outer annulus 23B of the spool assembly 22, the first hydraulic actuation ports 28 of the hydraulic sleeve 24, and the first fluid ports 40 of the housing 26, which defines hydraulic fluid pathway C; and, ii) an exit hydraulic fluid pathway B from the second hydraulic actuation chambers 17B to the inner fluid chamber 38 via the second fluid ports 42 of the housing 26 and the second hydraulic actuation ports 30 of the hydraulic sleeve 24. Once in the inner fluid chamber 38, returned hydraulic fluid from the second hydraulic actuation chambers 17B travels from the spring end 41 towards the actuation end 37 in a first fluid flow direction FD1 until exiting the spool assembly via vent aperture 35, defining a venting hydraulic fluid pathway V.

FIG. 12A depicts a fluid pressure condition in which the first and second one-way valves 50A, 50B are closed by a fluid pressure P1 within the second outer annulus 23B that acts on a first area AS1 of the axial stop surface 57 and a second area AS2 of an outer rim axial surface 92 of the first and second one-way valves 50A, 50B (see FIG. 6A). The sum of a first resultant force $RF1_{P1}$ due to the fluid pressure P1 acting on the first area AS1, and a second resultant force $RF2_{P1}$ due to the fluid pressure P1 acting on the second area AS2, overcomes a sum of: i) a spring force Fs of one of the first and second bias springs 75A,75B, ii) a third resultant force $RF3_{P2}$ due to a fluid pressure P2 of the inner fluid chamber 38 that acts on a third area AS3 of the axial spring abutment surface 58 of the first and second one-way valves 50A, 50B via respective third and second through-apertures 51, 31; and iii) a fourth resultant force $RF4_{P2}$ due to the fluid pressure P2 of the inner fluid chamber 38 that acts on a fourth area AS4 of the first axial stop surface 59. This pressure condition causes the first and second one-way valves 50A, 50B to move axially towards respective third and second lands 34, 32 of the spool assembly 22 until the first and second one-way valves 50A, 50B engage an axial motion stop. Therefore, axial movement of the first and second one-way valves 50A, 50B in a closing direction occurs when $RF1_{P1}+RF2_{P1}>Fs+RF3_{P2}+RF4_{P2}$. Force vectors for the forces $RF1_{P1}$, $RF2_{P1}$, $RF3_{P2}$, $RF4_{P2}$ and Fs are shown in FIGS. 6A and 6B. Given the opposed arrangement of the first and second one-way valves 50A, 50B shown in the Figures, a closing direction of the first one-way valve 50A is in a first axial direction FD1, while a closing direction of the second one-way valve 50B is in a second axial direction FD2. While in the closed position, the first axial stop surface 59 of the first and second one-way valves 50A, 50B engages, respectively, a first closed stop surface 92A of the first spool part 22A and a second closed stop surface 92B of the second spool part 22B. Thus, the first and second closed stop surfaces 92A, 92B serve as axial motion stops for the respective first and second one-way valves 50A, 50B when moving in a closing axial direction.

FIG. 12B, like FIG. 12A, also shows a cross-sectional view of the HFCV 20A that cuts through the fluid ports 40, 42 of the housing 26 while the spool assembly 22 is in the first extended position; however, FIG. 12B illustrates a pressure condition in which the first and second one-way valves 50A, 50B are in a fully open position, which is the default or "as assembled" position of the spool assembly 22. In this pressure condition, a pressure P1' of the second outer annulus 23B acting on: i) the axial stop surface 57 (yielding resultant force $RF1_{P1'}$), and ii) the outer rim axial surface 92 (yielding resultant force $RF2_{P1'}$) of the first and second one-way valves 50A, 50B, does not yield a closing force (summation of $RF1_{P1'}$ and $RF2_{P1'}$) that overcomes a sum of: i) the pre-load spring force Fp of the bias springs 75A, 75B, ii) a third resultant force $RF3_{P2'}$ resulting from a pressure P2' of the inner fluid chamber 38 acting on the axial spring abutment surface 58, and iii) a fourth resultant force $RF4_{P2'}$ resulting from the pressure P2' of the inner fluid chamber 38 acting on the first axial stop surface 59. Stated in mathematical form: $RF1_{P1'}+RF2_{P1'}<Fp+RF3_{P2'}+RF4_{P2'}$.

The hydraulic fluid paths shown in FIG. 12B are influenced by the fully open position of the first one-way valve 50A. The first extended position of the spool assembly 22 depicted in FIG. 12B facilitates: i) an exit hydraulic fluid pathway B' from the second hydraulic actuation chambers 17B to the inner fluid chamber 38 via the second fluid ports 42 of the housing 26 and the second hydraulic actuation ports 30 of the hydraulic sleeve 24. Once in the inner fluid chamber 38, returned hydraulic fluid from the second hydraulic actuation chambers 17B travels from the spring end 41 towards the actuation end 37 in the first fluid flow direction FD1 and splits into two separate hydraulic fluid pathways: a recirculation hydraulic fluid pathway R', and a venting hydraulic fluid pathway V'. The recirculation hydraulic fluid pathway R' extends from within the internal fluid chamber 38, through the third through-apertures 51 of the spool assembly 22, through the second outer annulus 23B of the spool assembly 22, through the first hydraulic actuation ports 28 of the hydraulic sleeve 24, through the first fluid ports 40, and to the first hydraulic actuation chambers 17A. The venting hydraulic fluid pathway V' extends longitudinally within the internal fluid chamber in the first fluid flow direction FD1 and exits the spool assembly 22 via the exit through-apertures 35.

In the first extended position of the spool assembly 22 shown in FIG. 12B, the HFCV 20A recirculates exiting hydraulic fluid from the second hydraulic actuation chambers 17B to the first hydraulic actuation chambers 17A. Such recirculation is accommodated by the first one-way valve 50A, a longitudinal position of which is controlled by hydraulic fluid pressure conditions within the HFCV 20A. This recirculation characteristic of the HFCV 20A not only facilitates timely delivery of pressurized hydraulic fluid to the first hydraulic actuation chambers 17A in a time of need, but also increases the efficiency of the camshaft phaser system 100 since at least a portion of the exiting hydraulic fluid from the second hydraulic actuation chambers 17B can be reused to actuate the camshaft phaser 10.

Given the closed position of the first and second one-way valves 50A, 50B of FIG. 12A along with the described associated axial motion stops, and the fully open position of the first and second one-way valves 50A, 50B of FIG. 12B along with the described associated axial motion stops, it should be stated that the axial position of the first and second one-way valves 50A, 50B is fully variable to any axial position between the closed and fully open positions.

FIG. 11B shows a cross-sectional view of the HFCV 20A that cuts through the longitudinal cut-outs 46 of the hydraulic sleeve 24 to clearly show a hydraulic fluid pathway A1 of the HFCV 20A when the spool assembly 22 is selectively moved to a second fully displaced position by the actuator 14. In this second fully displaced position of the spool assembly 22, hydraulic fluid moves through the inlet filter assembly 49 before it enters the hydraulic sleeve 24. The hydraulic fluid moves through the open one-way valve 72, through the longitudinal cut-outs 46 and the inlet ports 39 of the hydraulic sleeve 24, and into the second outer annulus 23B of the spool assembly 22. From the second outer annulus 23B, the hydraulic fluid continues to flow until it reaches the second hydraulic actuation chambers 17B as will now be explained.

FIG. 13A shows a cross-sectional view of the HFCV 20A that cuts through the fluid ports 40, 42 of the housing 26 while the spool assembly 22 is in its second fully displaced position to clearly show hydraulic fluid flow paths B1, C1, V1. The second fully displaced position of the spool assembly 22 facilitates: i) delivery of pressurized hydraulic fluid to the second hydraulic actuation chambers 17B via the second hydraulic actuation ports 30 and the second fluid ports 42, as defined by hydraulic fluid pathway C1; ii) an exit hydraulic fluid flow pathway B1 from the first hydraulic actuation chambers 17A to the inner fluid chamber 38 via the first fluid ports 40 and the first hydraulic actuation ports 28; and iii) a venting hydraulic fluid pathway V1 that extends from the inner fluid chamber 38 to a sump of the hydraulic fluid pressure source 82 via exit through-apertures 35 of the spool assembly 22.

FIG. 13A depicts a fluid pressure condition that causes the first and second one-way valves 50A, 50B to close. In this instance, which is similar to the fluid pressure condition (and previous discussion) for FIG. 12A, a fluid pressure P3 within the second outer annulus 23B acts on the first and second areas AS1, AS2 of each of the first and second one-way valves to provide a force that overcomes a sum of the spring force Fs (of one of the first and second bias springs 75A, 75B) and a force resulting from a fluid pressure P4 of the inner fluid chamber 38 that acts on the third area AS3 of each of the first and second one-way valves 50A, 50B.

FIG. 13B, like FIG. 13A, also shows a cross-sectional view of the HFCV 20A that cuts through the fluid ports 40, 42 of the housing 26 while the spool assembly 22 is in the second fully displaced position; however, FIG. 13B illustrates an example embodiment of a pressure condition that facilitates hydraulic fluid paths B1', C1', R1', C1'+R1', V1' via a partially open first one-way valve 50A. The spool assembly position and pressure condition depicted in FIG. 13B facilitates: i) delivery of pressurized hydraulic fluid (from the hydraulic fluid pressure source 82) to the second fluid ports 42 of the housing 26 via the second outer annulus 23B, and the second hydraulic actuation ports 30 and second fluid cut-outs 47 of the hydraulic sleeve 24, defining inlet hydraulic fluid pathway C1'; and ii) an exit hydraulic fluid pathway B1' from the first hydraulic actuation chambers 17A to the inner fluid chamber 38 via the first fluid ports 40 of the housing 26 and the first hydraulic actuation ports 28 of the hydraulic sleeve 24. Once inside of the inner fluid chamber 38, the exiting hydraulic fluid from the first hydraulic actuation chambers 17A splits into two hydraulic fluid pathways: a) a venting hydraulic fluid pathway V1' which extends in the first flow direction FD1 and exits out of the spool assembly 22 via exit through-apertures 35; and b) a recirculation hydraulic fluid pathway R1' which extends in the second flow direction FD2, through the first through-apertures 29 and second outer annulus 23B of the spool assembly 22 upon reaching the second hydraulic actuation ports 30 of the hydraulic sleeve 24. The inlet hydraulic fluid pathway C1' and the recirculation hydraulic fluid pathway R1' combine to form hydraulic fluid pathway C1'+R1' which extends from the second hydraulic actuation ports 30, through the second fluid cutout 47 and the inlet ports 39 of the hydraulic sleeve 24, through the second fluid ports 42 of the housing 26 and to the second hydraulic actuation chambers 17B.

In this example embodiment, the second hydraulic actuation chambers 17B receive hydraulic fluid from both the hydraulic fluid pressure source 82 and the first hydraulic actuation chambers 17A. The recirculation hydraulic fluid pathway R1' facilitates efficient recycling of hydraulic fluid from the first hydraulic actuation chambers 17A to the second hydraulic actuation chambers 17B. The amount of hydraulic fluid that is delivered to the second hydraulic actuation chambers 17B from the first hydraulic actuation chambers 17A via the recirculation hydraulic fluid pathway R' is dependent on need, or a pressure differential condition between the second outer annulus 23B of the spool assembly 22 and the inner fluid chamber 38 of the spool assembly 22. This pressure differential and the associated resultant forces acting on the first and second one-way valves 50A, 50B define the axial position of the first and second one-way valves 50A, 50B. Furthermore, the axial position of the first and second one-way valves 50A, 50B can dictate the amount of recirculating hydraulic fluid that is recirculated between the first and second hydraulic actuation chambers 17A, 17B. The partially open state of the first and second one-way valves 50A, 50B will now be described.

The first and second one-way valves 50A, 50B of FIG. 13B are subjected to forces that result from a hydraulic fluid pressure P3' within the second outer annulus 23B, a hydraulic fluid pressure P4' within the inner fluid chamber 38, and spring forces from the first and second bias springs 75A, 75B. In an example embodiment, linear compression springs with a constant spring rate are used for the first and second bias springs 75A, 75B. For simplicity purposes, it will be assumed that: i) the spring forces generated by each of the first and second bias springs 75A, 75B are equal (which may not be the case due to component tolerances); and ii) each of the first and second one-way valves 50A, 50B are subjected to the same hydraulic fluid pressures via the second outer annulus 23B and the inner pressure chamber 38. Based on these assumptions and for the sake of simplified discussion, the displacement of each of the first and second one-way valves 50A, 50B is equal.

Each of the first and second bias springs 75A, 75B are installed within each respective first and second spring cavities 91A, 91B such that they generate a pre-load force Fp on each of the first and second one-way valves 50A, 50B in their biased-open position. A spring force Fs generated from each of the bias springs can be mathematically represented by the spring force equation $Fs=Fp+(k\times x)$, where Fp is equal to the pre-load force, as installed; k is equal to the spring constant; and x is equal to the compression of the spring, which, for this embodiment, is equal to the displacement of each of the first and second one-way valves 50A, 50B from their stop positions against the connection tube 77. As displacement x of the one-way valves increases, the spring force Fs also increases. Applying these spring fundamentals further, the pressure condition of FIG. 13B yields an open position of the first and second one-way valves between the fully open axial stop position and the closed axial stop position where the following force equilibrium equation applies to each of the first and second one-way valves:

$$RF1_{P3'}+RF2_{P3'}=Fs+RF3_{P4'}+RF4_{P4'} \quad \text{(equation 1)}$$

where: $RF1_{P3'}$=resultant force due to pressure P3' acting on area AS1 of first and second one-way valves 50A, 50B (see FIG. 6A)

$RF2_{P3'}$=resultant force due to pressure P3' acting on area AS2 of first and second one-way valves 50A, 50B (see FIG. 6A)

$RF3_{P4'}$=resultant force due to pressure P4' acting on area AS3 of first and second one-way valves 50A, 50B (see FIG. 6B)

$RF4_{P4'}$=resultant force due to pressure P4' acting on area AS4 of first and second one-way valves 50A, 50B (see FIG. 6B)

Fs=spring force, first and second bias springs 75A, 75B

Since the spring force is equal to the sum of the pre-load force Fp and a force generated via displacement of the first and second one-way valves 50A, 50B, equation 1 can be changed to:

$$RF1_{P3'}+RF2_{P3'}=(Fp+(k\times x))+RF3_{P4'}+RF4_{P4'} \quad \text{(equation 2)}$$

where: x=displacement of first and second one-way valves 50A, 50B (see FIG. 13B)

Fp=pre-load force of first and second bias springs 75A, 75B k=spring rate of first and second bias springs 75A, 75B Therefore, in an example embodiment, for any maintained displacement "x" of the first and second one-way valves 50A, 50B, a force equilibrium relationship exists for each of the first and second one-way valves 50A, 50B that can be described by equation 2 above.

It is also possible to use non-linear compression springs such as progressive springs to bias each of the first and second one-way valves 50A, 50B. Furthermore, the spring rate k and preload Fp can be tuned to achieve the proper opening and closing characteristics of the first and second one-way valves 50A, 50B. While the above example embodiment assumes that the first one-way valve 50A is identical to the second one-way valve 50B, and the first bias spring 75A is identical to the second bias spring 75B, this does not need to be case.

While FIG. 13B shows a middle axial position of the first and second one-way valves 50A, 50B, it should be noted that any axial position is possible. The axial position of the first and second one-way valves 50A, 50B is fully variable to any axial position between the closed and fully open positions. Furthermore, the first and second one-way valves 50A,50B are capable of providing the fully variable functionality at any longitudinal position of the spool assembly 22.

FIG. 13C, like FIGS. 13A-13B, also shows a cross-sectional view of the HFCV 20A that cuts through the fluid ports 40, 42 of the housing 26 while the spool assembly 22 is in the second fully displaced position; however, FIG. 13C (similar to FIG. 12B) illustrates a pressure condition in which the first and second one-way valves 50A, 50B are in a fully open position. In this pressure condition, a pressure P3" of the hydraulic fluid within the second outer annulus 23B acting on the axial stop surface 57 and the outer rim axial surface 92 of the first and second one-way valves 50A, 50B does not yield a force that overcomes a sum of: i) the pre-load spring force Fp of the bias springs 75A, 75B, ii) a resultant force resulting from a pressure P4" of the hydraulic fluid within the inner fluid chamber 38 acting on the axial spring abutment surface 58 of the first and second one-way valves 50A, 50B, and iii) a resultant force resulting from the pressure P4" of the hydraulic fluid within the inner fluid chamber 38 acting on the first axial stop surface 59 of the first and second one-way valves 50A, 50B.

The hydraulic paths shown in FIG. 13C are influenced by the fully open position of the second one-way valve 50B. The second fully displaced position of the spool assembly 22 depicted in FIG. 13C facilitates: i) an exit hydraulic fluid pathway B1" from the first hydraulic actuation chambers 17A to the inner fluid chamber 38 via the first fluid ports 40 of the housing 26 and the first hydraulic actuation ports 28 of the hydraulic sleeve 24. Once within the inner fluid chamber 38, exiting or returned hydraulic fluid from the first hydraulic actuation chambers 17A splits into two hydraulic fluid pathways: a venting hydraulic fluid pathway V1" and a recirculation hydraulic fluid pathway R1'. The venting hydraulic fluid pathway V1" extends in the first flow direction FD1 and exits out of the spool assembly 22 via exit through-apertures 35. The recirculation hydraulic fluid pathway R1" extends in the second fluid flow direction FD2, through the first through-apertures 29 and the second outer annulus 23B of the spool assembly 22, through the second hydraulic actuation ports 30 and the second fluid cut-out 47 of the hydraulic sleeve 24, through the second fluid ports of the housing 26, and to the second hydraulic actuation chambers 17B.

FIG. 14 shows a cross-sectional view of the HFCV 20A that cuts through the fluid ports 40, 42 of the housing 26 while the spool assembly 22 is in a third displaced position. The "middle" position of the spool assembly 22 can be used to maintain a phasing position of the camshaft phaser 100, or, stated otherwise, maintain a constant rotational position of the rotor 11 relative to the stator 12. In this example embodiment, no fluid connection exists between the second outer annulus 23B of the spool assembly 22 and either of the first and second fluid ports 40, 42 of the housing 26 that are fluidly connected to the first and second hydraulic actuation chambers 17A, 17B; furthermore, no fluid connection exists between the first and second fluid ports and the spool assembly 22. However, FIG. 14 represents one of many design scenarios that are possible. In other example "middle spool position" embodiments, a small amount of flow to or from the first and second hydraulic actuation chambers 17A, 17B occurs.

A second example embodiment of a recirculating HFCV 20B is captured in FIGS. 15 through 18C. The difference between the HFCV 20B and the earlier described HFCV 20A is that the HFCV 20B includes a spool assembly 22' with a first one-way valve 50A' and a second one-way valve 50B' that are biased to a closed position by a single bias spring 75'. Other than the first and second one-way valves 50A', 50B' and the bias spring 75', all of the other components, including the first and second spool parts 22A, 22B and the connection tube 77, are the same as the previously described HFCV 20A. Furthermore, the functionality of the common components of the two HFCVs 20A, 20B is the same and need not be repeated to describe the functionality of the HFCV 20B.

Figure 15:
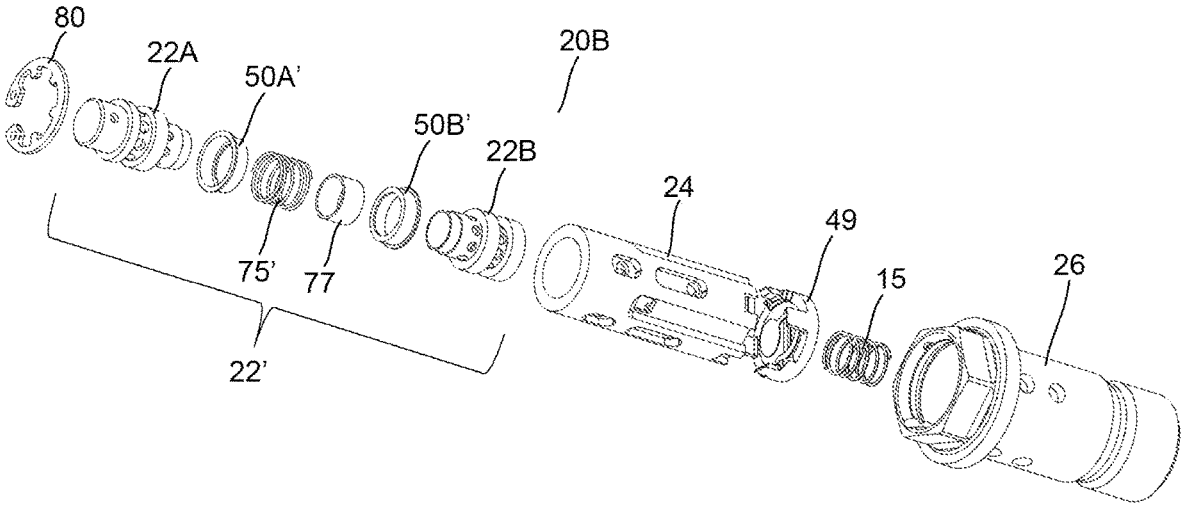
FIG. 15 is an exploded perspective view of a second example embodiment of the HFCV of FIG. 1 including a first spool part, a second spool part, a connection tube, two one-way valves, a one-way valve bias spring, a hydraulic sleeve, and an outer housing.
Figure 16A:
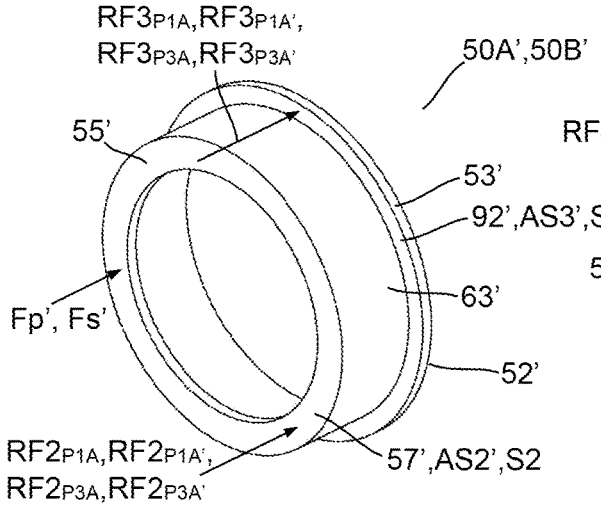
FIGS. 16A and 16B are perspective views of the two one-way valves of FIG. 15.
Figure 16B:
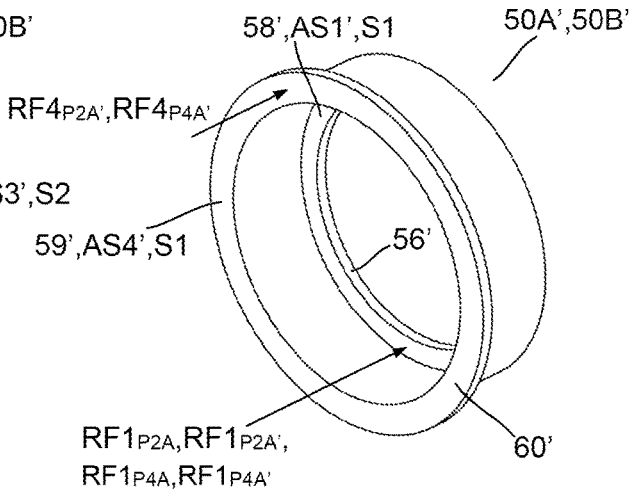
Figure 17A:
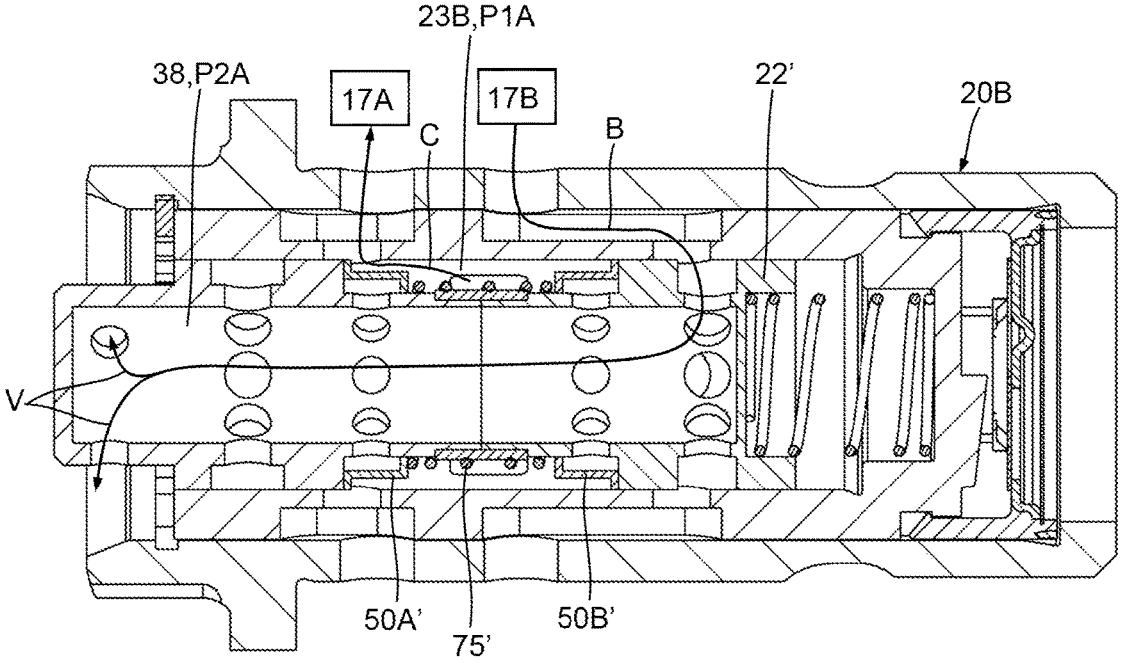
FIG. 17A is a cross-sectional view taken from a second example embodiment of the HFCV of FIG. 4 showing multiple hydraulic fluid paths when the spool is in an extended position, and the one-way valves are closed.
Figure 17B:
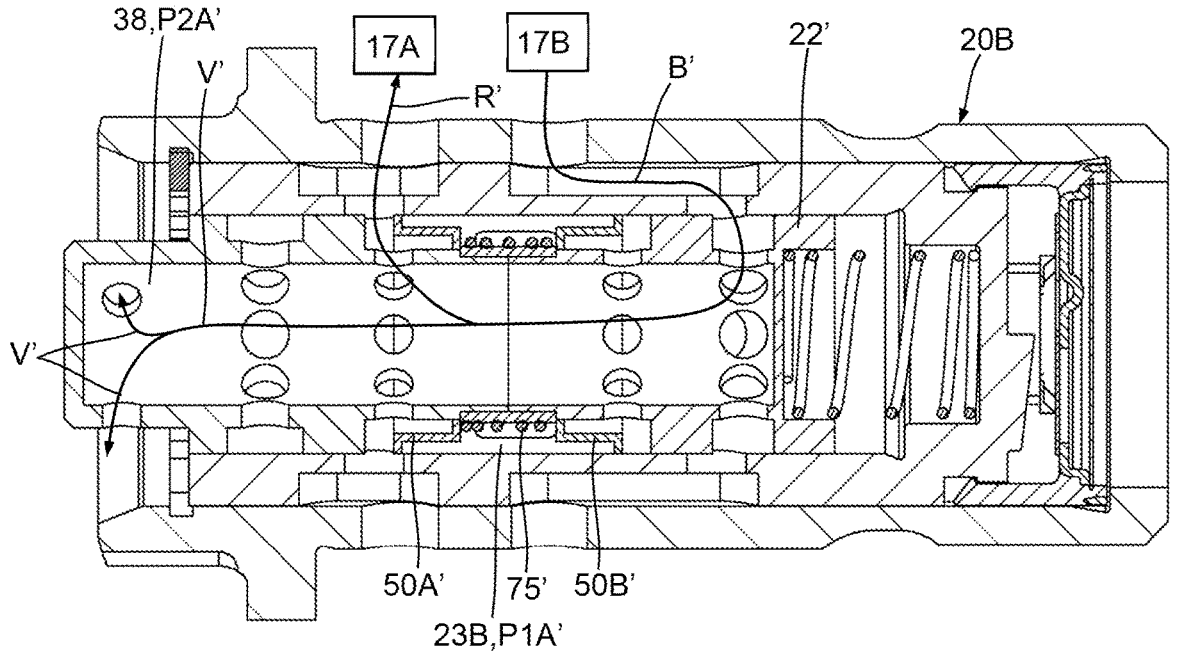
FIG. 17B is a cross-sectional view taken from the second example embodiment of the HFCV of FIG. 4 showing multiple hydraulic fluid paths when the spool is in an extended position, and the one-way valves are open.
Figure 18A:
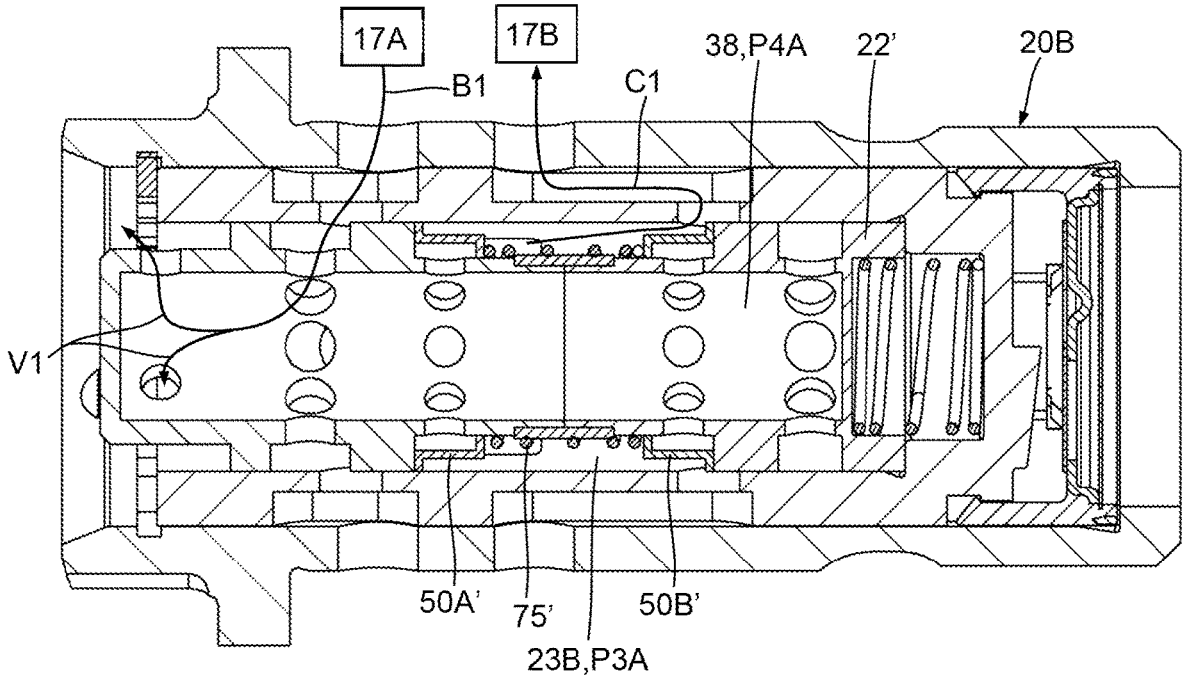
FIG. 18A is a cross-sectional view taken from the second example embodiment of the HFCV of FIG. 4 showing multiple hydraulic fluid paths when the spool is in a fully displaced position, and the one-way valves are closed.
Figure 18B:
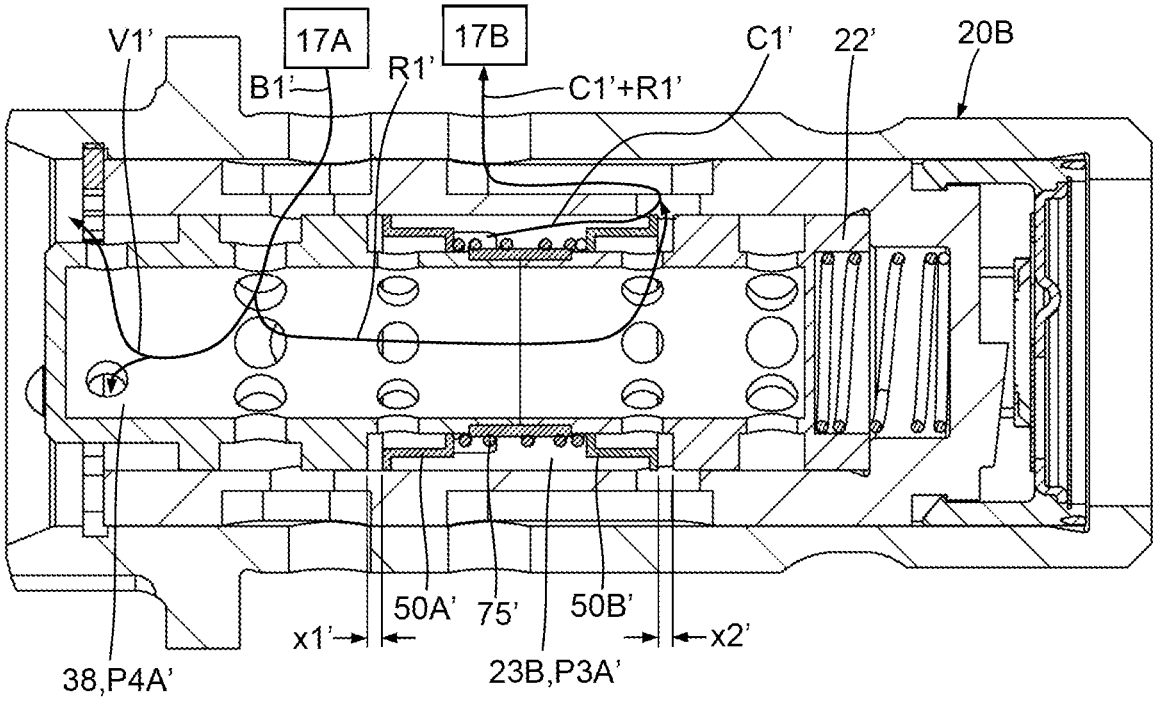
FIG. 18B is a cross-sectional view taken from the second example embodiment of the HFCV of FIG. 4 showing multiple hydraulic fluid paths when the spool is in a fully displaced position, and the one-way valves are partially open.
Figure 18C:
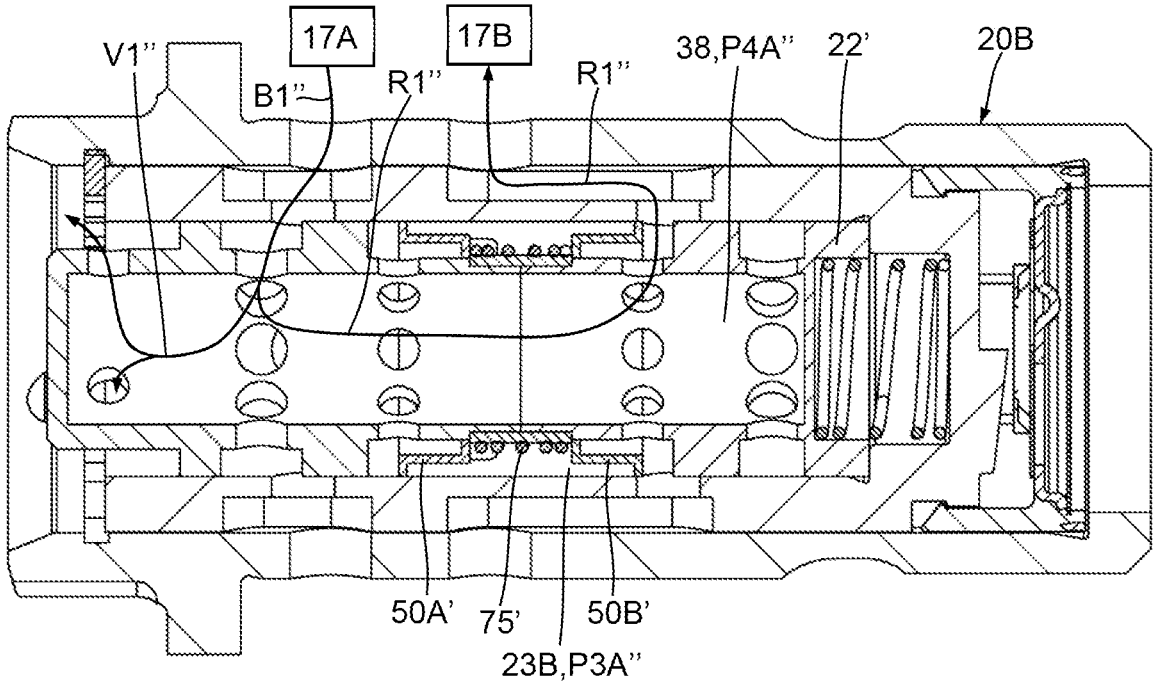
FIG. 18C is a cross-sectional view taken from the second example embodiment of the HFCV of FIG. 4 showing multiple hydraulic fluid paths when the spool is in a fully displaced position, and the one-way valves are fully open.

FIG. 4 is a perspective view of the HFCV 20B together with the hydraulic fluid pressure source 82. FIG. 15 is an exploded perspective view of the HFCV 20B, which includes the first spool part 22A, the second spool part 22B, the connection tube 77, the first one-way valve 50A', the second one-way valve 50B', the bias spring 75', the hydraulic sleeve 24, and the housing 26. FIGS. 16A and 16B are perspective views of the first and second one-way valves 50A', 50B' of FIG. 15. FIG. 17A is a cross-sectional view taken from the HFCV 20A of FIG. 4 showing multiple hydraulic fluid paths when the spool assembly 22' is in an extended position, and the first and second one-way valves 50A', 50B' are closed. FIG. 17B is a cross-sectional view taken from the HFCV 20B of FIG. 4 showing multiple hydraulic fluid paths when the spool assembly 22' is in an extended position, and the first and second one-way valves 50A', 50B' are fully open. FIG. 18A is a cross-sectional view taken from the HFCV 20B of FIG. 4 showing multiple hydraulic fluid paths when the spool assembly 22' is in a fully displaced position, and the first and second one-way valves 50A', 50B' are closed. FIG. 18B is a cross-sectional view taken from the HFCV 20B of FIG. 4 showing multiple hydraulic fluid paths when the spool assembly 22' is in a fully displaced position, and the first and second one-way valves 50A', 50B' are partially open. FIG. 18C is a cross-sectional view taken from the HFCV 20B of FIG. 4 showing multiple hydraulic fluid paths when the spool assembly 22' is in a fully displaced position, and the first and second one-way valves 50A', 50B' are fully open. The following discussion should be read in light of FIGS. 4 and 15 through 18C.

As shown in FIGS. 16A and 16B, the first and second one-way valves 50A', 50B', which are duplicative in design, include an inner rim 55' and an outer rim 60' that are separated by a cylindrical body 63'. The inner rim 55' has a radial inner surface 56' that is slidably and sealingly guided by a radial surface 90 of the second outer annulus 23B of the spool assembly 22'. The outer rim 60' has a radial outer surface 53' that is slidably and sealingly guided by a radial surface 25 of the bore 61 of the hydraulic sleeve 24. The bias spring 75' is installed within the second outer annulus 23B of the spool assembly 22' in a pre-loaded condition between the first and second one-way valves 50A', 50B'. More specifically, the bias spring 75' is installed around the connection tube 77 arranged within the second outer annulus 23B. In an example embodiment, the bias spring 75' is longitudinally guided by the radial outer surface 88 of the connection tube 77.

The first and second one-way valves 50A', 50B are biased to a closed position by the bias spring 75' such that a first axial stop surface 59' of the first and second one-way valves 50A', 50B' engages, respectively, the first closed stop surface 92A of the first spool part 22A, and the second closed stop surface 92B of the second spool part 22B. Thus, the first and second closed stop surfaces 92A, 92B serve as axial motion stops for the respective first and second one-way valves 50A', 50B' when they are in their biased closed position.

The first and second one-way valves 50A', 50B': i) permit or provide hydraulic fluid flow from the inner fluid chamber 38 to the first hydraulic actuation chamber 17A or the second hydraulic actuation chamber 17B via the third and second through-apertures 51, 31; and ii) prevent hydraulic fluid flow from the first hydraulic actuation chamber 17A and the second hydraulic actuation chamber 17B to the inner fluid chamber 38. The first and second one-way valves 50A', 50B' can be of any suitable design for the described function and do not have to be that which is described herein and shown in the figures.

FIG. 17A shows a cross-sectional view of the HFCV 20B that cuts through the fluid ports 40, 42 of the housing 26 while the spool assembly 22' is in the first extended position to clearly show hydraulic fluid paths B, C, V. These hydraulic fluid paths B, C, V are a duplicate of those shown in FIG. 12A, therefore a repeat discussion of these pathways is not necessary. However, due to the different one-way valve configuration of the HFCV 20B (biased-closed), the forces acting on the first and second one-way valves 50A', 50B' are different than that described for the first and second one-way valves 50A, 50B of FIG. 12A, which will now be discussed.

FIG. 17A depicts a fluid pressure condition in which the first and second one-way valves 50A', 50B' are in a closed position, which is the default or "as assembled" position of the spool assembly 22'. In this pressure condition, a fluid pressure P2A within the inner fluid chamber 38 that acts on a first area AS1' of an inner axial surface 58' of the inner rim 55', yielding a first resultant force $RF1_{P2A}$, does not overcome a sum of: i) a pre-load force Fp' of the bias spring 75' acting on a second area AS2' of an axial stop surface 57', ii) a second resultant force $RF2_{P1A}$ due to a fluid pressure P1A of the second outer annulus 23B that acts on the second area AS2' of the axial stop surface 57', and iii) a third resultant force $RF3_{P1A}$ due to the fluid pressure P1A of the second outer annulus 23B that acts on a third area AS3' of the outer rim axial surface 92'. FIGS. 16A and 16B show the aforementioned force vectors, associated surfaces, and areas.

FIG. 17B shows a cross-sectional view of the HFCV 20B that cuts through the fluid ports 40, 42 of the housing 26 while the spool assembly 22' is in the first extended position to clearly show hydraulic fluid paths B', R', V'. These hydraulic fluid paths are a duplicate of those shown in FIG. 12B, therefore a repeat discussion of these pathways is not necessary. However, due to the different one-way valve configuration of the HFCV 20B (biased-closed), the forces acting on the first and second one-way valves 50A', 50B' are different than that described for the first and second one-way valves 50A, 50B of FIG. 12B, which will now be discussed.

FIG. 17B depicts a fluid pressure condition in which the first and second one-way valves 50A', 50B' are moved to a fully open position by a fluid pressure P2A' within the inner fluid chamber 38 that acts on: i) a fourth area AS4' of the first axial stop surface 59' to produce a fourth resultant force $RF4_{P2A'}$, and ii) the first area AS1' of the inner axial surface 58' to produce a first resultant force $RF1_{P2A'}$. The sum of the fourth resultant force $RF4_{P2A'}$ and the first resultant force $RF1_{P2A'}$ overcome a sum of: i) a spring force Fs' of the bias spring 75' that acts on the axial stop surface 57', ii) a second resultant force $RF2_{P1A'}$ produced from a fluid pressure P1A' within the second outer annulus 23B that acts on the second area AS2' of the axial stop surface 57', and iii) a third resultant force $RF3_{P1A'}$ produced from the fluid pressure P1A' within the second outer annulus 23B that acts on the third area AS3' of the outer rim axial surface 92'.

FIG. 18A shows a cross-sectional view of the HFCV 20B that cuts through the fluid ports 40, 42 of the housing 26 while the spool assembly 22' is in the second fully displaced position to clearly show hydraulic fluid paths B1, C1, V1. These hydraulic fluid paths are a duplicate of those shown in FIG. 13A, therefore a repeat discussion of these pathways is not necessary. However, due to the different one-way valve configuration of the HFCV 20B (biased-closed), the forces acting on the first and second one-way valves 50A', 50B' are different than that described for the first and second one-way valves 50A, 50B of FIG. 13A, which will now be discussed.

FIG. 18A depicts a fluid pressure condition in which the first and second one-way valves 50A', 50B' are in a closed position, which is the default or "as assembled" position of the spool assembly 22'. While in the closed position, the first axial stop surface 59' of the outer rim 52' of the first one-way valve 50A' abuts with or is engaged with the first closed stop surface 92A of the spool assembly 22'; and, the first axial stop surface 59' of the outer rim 52' of the second one-way valve 50B' abuts with or is engaged with the second closed stop surface 92B of the spool assembly 22'. In this pressure condition, a fluid pressure P4A within the inner fluid chamber 38 that acts on a first area AS1' of an inner axial surface 58' of the inner rim 55', yielding a first resultant force $RF1_{P4A}$, does not overcome a sum of: i) a pre-load force Fp' of the bias spring 75' acting on the inner rim 55', ii) a second resultant force $RF2_{P3A}$ due to a fluid pressure P3A of the second outer annulus 23B that acts on the second area AS2' of the axial stop surface 57', and iii) a third resultant force $RF3_{P3A}$ due to the fluid pressure P3A of the second outer annulus 23B that acts on a third area AS3' of the outer rim axial surface 92'. This condition can be represented mathematically by the following: $RF1_{P4A}<Fp'+RF2_{P3A}+RF3_{P3A}$. FIGS. 16A and 16B show the aforementioned force vectors, associated surfaces, and areas. It should be noted that axial movement of the first and second one-way valves 50A', 50B' in an opening direction occurs when $RF1_{P4A}>Fp'+RF2_{P3A}+RF3_{P3A}$.

FIG. 18B shows a cross-sectional view of the HFCV 20B that cuts through the fluid ports 40, 42 of the housing 26 while the spool assembly 22' is in the second fully displaced position to clearly show hydraulic fluid pathways B1', C1', R1', C1'+R1', V1' due to partially open one-way valves 50A', 50B'. These hydraulic fluid pathways are a duplicate of those shown in FIG. 13B, therefore a repeat discussion of these pathways is not necessary. However, due to the different one-way valve configuration of the HFCV 20B (biased-closed), the forces acting on the first and second one-way valves 50A', 50B' are different than that described for the first and second one-way valves 50A, 50B of FIG. 13B, which will now be discussed.

The partially open states of the first and second one-way valves 50A', 50B' of FIG. 18B are due to forces that result from fluid pressures within the second outer annulus 23B and the inner fluid chamber 38 and a spring force from the bias spring 75'. In an example embodiment, a linear compression spring with a constant spring rate is used for the bias spring 75' to simultaneously bias the first and second one-way valves 50A', 50B' to the closed position with a preload force Fp. A spring force Fs generated from this bias spring 75' can be mathematically represented by the equation of Fs'=Fp'+(k'×x'), where Fp' is equal to the pre-load force, as installed; k' is equal to the spring constant; and x' is equal to the compression of the spring, which, in this example embodiment, is equal to the additive displacement of the first and second one-way valves 50A', 50B'. As compression x' of the bias spring increases (or displacement of the one-way valves increases), the spring force Fs' also increases.

Applying these spring fundamentals further, the pressure condition of FIG. 18B yields a partially open position of the first and second one-way valves between the fully open axial stop position and the closed axial stop position where the following force equilibrium equation applies to each one of the first and second one-way valves:

$$RF1_{P4A}+RF4_{P4A'}=Fs'+RF2_{P3A}+RF3_{P3A'} \quad \text{(equation 3)}$$

where: $RF1_{P4A}$=resultant force due to pressure P4A' acting on area AS1' (see FIG. 16B) of first and second one-way valves 50A', 50B'

$RF4_{P4A'}$=resultant force due to pressure P4A' acting on area AS4' (see FIG. 16B) of first and second one-way valves 50A', 50B'

$RF2_{P3A'}$=resultant force due to pressure P3A' acting on area AS3' (see FIG. 16A) of first and second one-way valves 50A', 50B'

$RF4_{P3A'}$=resultant force due to pressure P4A' acting on area AS4' (see FIG. 16A) of first and second one-way valves 50A', 50B'

Fs'=spring force of bias spring 75'

Since the spring force is equal to the sum of the pre-load force Fp' and the compression force of the bias spring 75' due to displacement of the first and second one-way valves 50A', 50B', equation 3 can be changed to:

$$RF1_{P4A}+RF4_{P4A'}=(Fp'+(k'\times(x1'+x2'))+RF2_{P3A}+RF3_{P3A'} \quad \text{(equation 4)}$$

where: x1'=displacement of first one-way valve 50A' (see FIG. 18B)

x2'=displacement of second one-way valve 50B' (see FIG. 18B)

Fp'=pre-load force of bias spring 75' k'=spring rate of bias spring 75'

Therefore, for any maintained displacement x1', x2' of the respective first and second one-way valves 50A', 50B', a force equilibrium relationship exists for each of the first and second one-way valves 50A', 50B' that can be described by equation 4 above.

It is also possible to use non-linear compression springs such as progressive springs to bias each of the first and second one-way valves 50A', 50B'. Furthermore, the spring rate k' and preload Fp' can be tuned to achieve the proper opening and closing characteristics of the first and second one-way valves 50A', 50B'. While the above example embodiment assumes that the first one-way valve 50A' is identical to the second one-way valve 50B', this does not need to be case. Furthermore, further example embodiments not shown in the Figures could utilize separate bias springs for each of the first and second one-way valves 50A', 50B'.

FIG. 18C shows a cross-sectional view of the HFCV 20B that cuts through the fluid ports 40, 42 of the housing 26 while the spool assembly 22' is in the second fully displaced position to clearly show hydraulic fluid pathways B1", R1", V1" and fully open first and second one-way valves 50A', 50B'. The hydraulic fluid pathways are a duplicate of those shown in FIG. 13C, therefore a repeat discussion of these pathways is not necessary. The fully open state of the first and second one-way valves 50A', 50B' is achieved when, at a maximum displaced position of the one-way valves, a summation of forces acting on first and fourth areas AS1', AS4' of a first side S1 (see FIG. 16B) of the one-way valves 50A', 50B' due to a fluid pressure P4A" within the inner fluid chamber 38, equals or exceeds a summation of: i) a summation of forces generated on second and third areas AS2', AS3' of a second side S2 (see FIG. 16A) of the one-way valves 50A', 50B' due to a fluid pressure P3A" within the second outer annulus 23B; and ii) a spring force generated on the second area AS2' of the second side S2 of the one-way valves 50A', 50B' by the bias spring 75' that results from the maximum displaced position(s) of the one-way valves.

FIG. 18C shows the first and second one-way valves 50A', 50B' engaged with the connection tube 77 defining a stop position where: a) the second axial stop surface 57' of the inner rim 55' of the first one-way valve 50A' engages the first stop abutment surface 71 of the connection tube 77, and b) the second axial stop surface 57' of the second one-way valve 50B' engages the second stop abutment surface 73 of the connection tube 77.

The size or diameter of the exit through-apertures 35 can be adjusted to tune the amount of recirculation that occurs within the previously described HFCV embodiments 20A, 20B. This amount could be dependent upon the magnitude of the camshaft torsionals acting on the camshaft phaser; for example, higher camshaft torsionals may require a smaller sized vent through-aperture. In some applications, the exit through-apertures 35 could even be eliminated so that the inner fluid chamber serves to exclusively facilitate recirculation without directing any fluid to tank.

Figure 19:
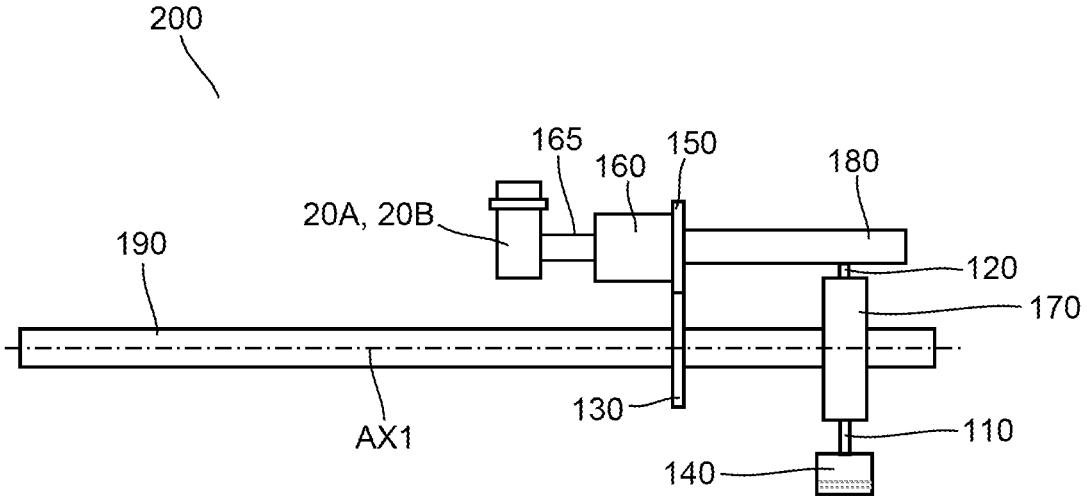
FIG. 19 is a schematic view of a phaser system for a cranktrain of an internal combustion engine.

FIG. 19 illustrates a schematic diagram showing the arrangement of a cranktrain 200. As used herein, the term cranktrain 200 can refer to an arrangement that generally includes a piston 140, a crankshaft 190, and an eccentric shaft 180. A phase adjuster 160, in one aspect, is configured to adjust phasing between the crankshaft 190 and the eccentric shaft 180, which varies a compression ratio of an IC engine. In general, the phase adjuster 160 is hydraulically actuated via any of the previously described HFCVs 20A, 20B and is configured to continuously adjust between a high compression ratio and low compression ratio, depending on the driving conditions. One goal of a phase adjuster is to maintain the most efficient engine operating point in any driving condition, either from a fuel economy standpoint or power demand standpoint. In other words, the phase adjuster 160 is configured to change or modify a phase of the eccentric shaft 180 relative to the crankshaft 190 with the aid of pressurized hydraulic fluid delivered from the HFCV 20A, 20B via oil galleries 165. FIG. 19 is a schematic drawing and the exact positioning of components relative to each other can vary.

The cranktrain 200 includes a crankshaft 190, an eccentric shaft 180, a connecting plate 170, a first connecting rod 120, a second connecting rod 110, a piston 140, a first gear 150, a second gear 130, either of the previously described HFCVs 20A, 20B, and the phase adjuster 160. The first connecting rod 120 connects the eccentric shaft 180 to the connecting plate 170 and the second connecting rod 110 connects the piston 140 to the connecting plate 170. The connecting plate 170 is non-rotatably connected to the crankshaft 190 and rotates about a rotational axis AX1 of the crankshaft 190. The phase adjuster 160 is configured to change a phase of the eccentric shaft 180 relative to the crankshaft 190 which, in turn, varies an orientation of the connecting plate 170 relative to the crankshaft 190. Other cranktrain configurations that facilitate a variable compression ratio are also possible.

In one aspect, the phase adjuster 160 has a gear train configured to operatively connect the crankshaft 190 to the eccentric shaft 180. The gear train can comprise gears 130, 150 which are shown in FIG. 19 for illustrative purposes. The ratio and sizing of the gears 130, 150. Other driving engagements can be provided.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A hydraulic fluid control valve, comprising:

a housing including:

a first fluid port configured to be fluidly connected to a first hydraulic actuation chamber; and, a second fluid port configured to be fluidly connected to a second hydraulic actuation chamber, the first and second hydraulic actuation chambers configured to receive and exhaust hydraulic fluid; and, a spool assembly configured to move axially within the housing so as to route the hydraulic fluid to and from the first and second fluid ports, the spool assembly including:

a first spool part;

a second spool part configured as a separate component from the first spool part;

an inner fluid chamber formed by the first and second spool parts, the inner fluid chamber including a vent aperture and at least one recirculation aperture, the inner fluid chamber configured to: i) receive the hydraulic fluid vented from one of the first or second hydraulic actuation chamber, ii) exhaust a first portion of the vented hydraulic fluid from the spool assembly via the vent aperture, and iii) recirculate a remaining portion of the vented hydraulic fluid to a remaining one of the first or second hydraulic actuation chamber via the at least one recirculation aperture and at least one one-way valve; and, a connection tube configured to: i) attach the first spool part to the second spool part, and ii) provide an axial motion stop for the at least one one-way valve.

2. The hydraulic fluid control valve of claim 1, wherein the hydraulic fluid control valve is configured to manage hydraulic fluid flow for a camshaft phaser or for a cranktrain phasor of an internal combustion engine.

3. The hydraulic fluid control valve of claim 1, wherein the first and second spool parts define an outer annulus configured to be in selective fluid communication with the first and second fluid ports.

4. The hydraulic fluid control valve of claim 3, wherein the at least one one-way valve is arranged within the outer annulus.

5. The hydraulic fluid control valve of claim 4, wherein the at least one one-way valve is slidably guided in an axial direction along the outer annulus.

6. The hydraulic fluid control valve of claim 4, wherein at least a portion of the connection tube extends within the outer annulus.

7. The hydraulic fluid control valve of claim 4, wherein the at least one one-way valve comprises a first one-way valve and a second one-way valve.

8. The hydraulic fluid control valve of claim 7, wherein the spool assembly further includes a bias spring pressed between the first and second one-way valves.

9. The hydraulic fluid control valve of claim 8, wherein the bias spring biases the first and second one-way valves toward a closed position.

10. The hydraulic fluid control valve of claim 7, wherein the spool assembly further includes a first bias spring and a second bias spring configured to respectively bias the first one-way valve and the second one-way valve toward an open position.

11. The hydraulic fluid control valve of claim 7, wherein the axial motion stop includes a first axial motion stop formed at a first end of the connection tube for the first one-way valve, and a second axial motion stop formed at a second end of the connection tube for the second one-way valve.

12. The hydraulic fluid control valve of claim 7, wherein the first one-way valve opens in a first axial direction and the second one-way valve opens in a second axial direction, opposite the first axial direction.

13. A hydraulic fluid control valve, comprising:

a housing including:

a first fluid port configured to be fluidly connected to a first hydraulic actuation chamber; and, a second fluid port configured to be fluidly connected to a second hydraulic actuation chamber, the first and second hydraulic actuation chambers configured to receive and exhaust hydraulic fluid; and, a hydraulic sleeve disposed within the housing, the hydraulic sleeve including longitudinal cutouts configured to receive the hydraulic fluid from a hydraulic fluid pressure source;

a spool assembly configured to move axially within the hydraulic sleeve so as to route the hydraulic fluid to and from the first and second fluid ports, the spool assembly including:

an outer annulus configured to be selectively fluidly connected to the first and second fluid ports; and an inner fluid chamber including a vent aperture and at least one recirculation aperture, the inner fluid chamber configured to: i) receive the hydraulic fluid vented from one of the first or second hydraulic actuation chamber, ii) exhaust a first portion of the vented hydraulic fluid from the spool assembly via the vent aperture, and iii) recirculate a remaining portion of the vented hydraulic fluid to a remaining one of the first or second hydraulic actuation chamber via the at least one recirculation aperture and at least one one-way valve, wherein the at least one one-way valve includes a radial inner surface slidably guided along the outer annulus, and a radial outer surface slidably guided along the hydraulic sleeve.

14. The hydraulic fluid control valve of claim 13, wherein the at least one one-way valve is arranged within the outer annulus.

15. The hydraulic fluid control valve of claim 14, wherein the outer annulus is further configured as an axial motion stop for the at least one one-way valve.

16. The hydraulic fluid control valve of claim 15, wherein the at least one one-way valve comprises a first one-way valve and a second one-way valve.

17. The hydraulic fluid control valve of claim 16, wherein the spool assembly further includes a bias spring pressed between the first and second one-way valves.

18. The hydraulic fluid control valve of claim 17, wherein the bias spring biases the first and second one-way valves toward a closed position.

19. The hydraulic fluid control valve of claim 16, wherein the spool assembly further includes a first bias spring housed within an axially extending first spring cavity of the first one-way valve, and a second bias spring housed within an axially extending second spring cavity of the second one-way valve.

20. The hydraulic fluid control valve of claim 19, wherein the first and second bias springs are configured to respectively bias the first and second one-way valves toward an open position.

* * * * *